US011587507B2

(12) United States Patent
Lee et al.

(10) Patent No.: US 11,587,507 B2
(45) **Date of Patent: *Feb. 21, 2023**

(54) DISPLAY APPARATUS

(71) Applicant: LG DISPLAY CO., LTD., Seoul (KR)

(72) Inventors: JungHyun Lee, Paju-si (KR); Yewon Hong, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/484,596

(22) Filed: Sep. 24, 2021

(65) Prior Publication Data

US 2022/0013065 A1 Jan. 13, 2022

Related U.S. Application Data

(63) Continuation of application No. 16/513,930, filed on Jul. 17, 2019, now Pat. No. 11,158,260.

(30) Foreign Application Priority Data

Jul. 20, 2018 (KR) ..... 10-2018-0084953

(51) Int. Cl.
*G09G 3/325* (2016.01)
*G09G 3/3275* (2016.01)

(52) U.S. Cl.
CPC ..... *G09G 3/325* (2013.01); *G09G 3/3275* (2013.01); *G09G 2310/0251* (2013.01); *G09G 2310/0297* (2013.01)

(58) Field of Classification Search
CPC ..... G09G 3/325; G09G 3/3275; G09G 2310/0251; G09G 2310/0297
See application file for complete search history.

(56) References Cited

U.S. PATENT DOCUMENTS

| | | | | |
|---|---|---|---|---|
| 7,742,021 | B2 | 6/2010 | Shin | |
| 7,804,468 | B2 | 9/2010 | Park | |
| 8,674,918 | B1 | 3/2014 | Fan | |
| 11,158,260 | B2 * | 10/2021 | Lee | G09G 3/325 |
| 11,386,851 | B2 * | 7/2022 | Park | G09G 3/3291 |

(Continued)

FOREIGN PATENT DOCUMENTS

| | | | |
|---|---|---|---|
| CN | 1693942 | A | 11/2005 |
| CN | 1952765 | A | 4/2007 |
| CN | 107016970 | A | 8/2017 |

OTHER PUBLICATIONS

Chinese Office Action dated Oct. 29, 2021 issued in corresponding Patent Application No. 201910649813.6 w/English Translation (17 pgs).

*Primary Examiner* — Dmitriy Bolotin
(74) *Attorney, Agent, or Firm* — Polsinelli PC

(57) ABSTRACT

A display apparatus comprises a demultiplexing circuit portion that sequentially supplies data signals supplied from a data driving circuit to at least two data lines, and the demultiplexing circuit portion of the display apparatus comprises a switching portion that sequentially supplies the data signals to the at least two data lines based on a voltage of a control line; a voltage controller that controls the voltage of the control line in response to a time-division control signal; and a voltage discharge portion that discharges the voltage of the control line in response to the time-division control signal.

19 Claims, 26 Drawing Sheets

(56) References Cited

U.S. PATENT DOCUMENTS

| | | | |
|---|---|---|---|
| 2006/0087488 | A1 | 4/2006 | Ito |
| 2008/0303749 | A1 | 12/2008 | Cassidy |
| 2009/0207104 | A1 | 8/2009 | Lee |
| 2009/0207110 | A1 | 8/2009 | Lee |
| 2016/0209808 | A1 | 7/2016 | Byun |
| 2016/0329025 | A1 | 11/2016 | Park |
| 2017/0061853 | A1 | 3/2017 | Yang |
| 2017/0115807 | A1 | 4/2017 | Cho |
| 2018/0059838 | A1 | 3/2018 | Chung |
| 2018/0301104 | A1 | 10/2018 | Hao |
| 2019/0108783 | A1 | 4/2019 | Sun |
| 2019/0362666 | A1 | 11/2019 | Chen |

* cited by examiner

DISPLAY APPARATUS

CROSS-REFERENCE TO RELATED APPLICATION

This application is a continuation of U.S. patent application Ser. No. 16/513,930, filed Jul. 17, 2019, which claims the benefit of the Korean Patent Application No. 10-2018-0084953 filed on Jul. 20, 2018, which are hereby incorporated by reference in their entirety and for all purposes.

BACKGROUND

Field of the Disclosure

The present disclosure relates to a display apparatus. Although the present disclosure is suitable for a wide scope of applications, it is particularly suitable for maintaining a stable output for the display apparatus having a demultiplexing circuit that uses an oxide based thin film transistor by reinforcing a discharge function of a control line in response to a time-division control signal.

Description of the Background

A display apparatus is widely used as a display screen of a notebook computer, a tablet computer, a smartphone, a portable display device, and a portable information device in addition to a display apparatus of a television or a monitor.

The display apparatus includes a display panel and a driving integrated circuit and a scan driving circuit for driving the display panel. The display panel includes a plurality subpixels provided per pixel area defined by a plurality of data lines and a plurality of gate lines, having a thin film transistor. In this case, at least three adjacent subpixels constitute a unit pixel for displaying an image.

The driving integrated circuit is connected with each of the plurality of data lines in a one-to-one relationship through a plurality of data link lines. The driving integrated circuit supplies a data voltage to each of the plurality of data lines. The scan driving circuit is connected with each of the plurality of gate lines in a one-to-one relationship through a plurality of gate link lines. The scan driving circuit supplies a scan signal to each of the plurality of gate lines.

Generally, the display apparatus may use a low-temperature polycrystalline silicon (LTPS) based thin film transistor and an oxide based thin film transistor. In the display apparatus of the background, the driving integrated circuit is packaged in a flexible circuit film to reduce a bezel area there below, and the number of channels of the driving integrated circuit is reduced through data time-division driving using demultiplexing circuits.

At this time, the display apparatus needs a demultiplexing circuit based on the oxide based thin film transistor to embody an image of high resolution while reducing the number of channels of the driving integrated circuit. However, the oxide based thin film transistor has problems in that electron mobility is lower than that of the LTPS based thin film transistor and degradation may occur if it is used for a long period of time. Also, if electron mobility of the thin film transistor of the demultiplexing circuit is reduced, it is difficult to embody an image of high resolution, and if the thin film transistor of the demultiplexing circuit is degraded, an off current transferred to an organic light emitting diode occurs. As a result, luminance of the display panel can be deteriorated.

Therefore, a technology capable of stably maintaining an output of the demultiplexing circuit using the oxide based thin film transistor by solving the above problem is required.

SUMMARY

The present disclosure has been made in view of the above problems, and the present disclosure is to provide a display apparatus comprising a demultiplexing circuit portion using an oxide based thin film transistor, the demultiplexing circuit potion being capable of maintaining a stable output by overcoming a limitation due to low mobility and degradation as compared with an LTPS based thin film transistor by reinforcing a discharge function of a control line in response to a time-division control signal.

The present disclosure to provide a display apparatus comprising a demultiplexing circuit portion using an oxide based thin film transistor, in which off current capable of being transferred to an organic light emitting diode is prevented from occurring, a bezel area is minimized, and an image of high resolution of a display panel is embodied.

The present disclosure to provide a display apparatus in which a demultiplexing circuit portion using an oxide based thin film transistor is embodied through a back channel etch (BCE) process to minimize a mask process, improve a lithography process margin and provide excellent reliability.

In addition to the above mentioned aspects, additional features of the present disclosure will be clearly understood by those skilled in the art from the following description of the present disclosure.

In accordance with an aspect of the present disclosure, the above and other aspects can be accomplished by the provision of a display apparatus comprising a demultiplexing circuit portion for sequentially supplying data signals supplied from a data driving circuit to at least two data lines, the demultiplexing circuit portion including a switching portion for sequentially supplying the data signals to at least two data lines based on a voltage of a control line, a voltage controller for controlling the voltage of the control line in response to a time-division control signal, and a voltage discharge portion for discharging the voltage of the control line in response to the time-division control signal.

In accordance with another aspect of the present disclosure, the above and other aspects can be accomplished by the provision of a display apparatus comprising n data lines, a demultiplexing circuit portion connected to first to $i^{th}$ (i is a natural number of 2 or more) control lines and connected to the n data lines, and a data driving circuit having first to $n/i^{th}$ output channels connected to the demultiplexing circuit portion, the demultiplexing circuit portion including a voltage controller for controlling voltages of the first to $i^{th}$ control lines in response to first to $i^{th}$ time-division control signals, a switching portion for sequentially supplying data signals supplied from the first to $n/i^{th}$ output channels to the n data lines based on the voltage of each of the first to $i^{th}$ control lines, and a voltage discharge portion for discharging the voltages of the first to $i^{th}$ control lines in response to the first to $i^{th}$ time-division control signals.

Details of the other aspects are included in the detailed description and drawings.

Since the display apparatus according to the present disclosure comprises a demultiplexing circuit portion using an oxide based thin film transistor, the demultiplexing circuit portion is capable of maintaining a stable output by overcoming a limitation due to low mobility and degradation as compared with an LTPS based thin film transistor by reinforcing a discharge function of a control line in response to a time-division control signal.

Since the display apparatus according to the present disclosure comprises a demultiplexing circuit portion using an oxide based thin film transistor, off current capable of being transferred to an organic light emitting diode may be prevented from occurring, a bezel area may be minimized, and an image of high resolution of a display panel may be embodied.

In the display apparatus according to the present disclosure, a demultiplexing circuit portion using an oxide based thin film transistor is embodied through a back channel etch (BCE) process, whereby it is possible to minimize a mask process, improve a lithography process margin and provide excellent reliability.

In addition to the effects of the present disclosure as mentioned above, additional advantages and features of the present disclosure will be clearly understood by those skilled in the art from the following description of the present disclosure.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
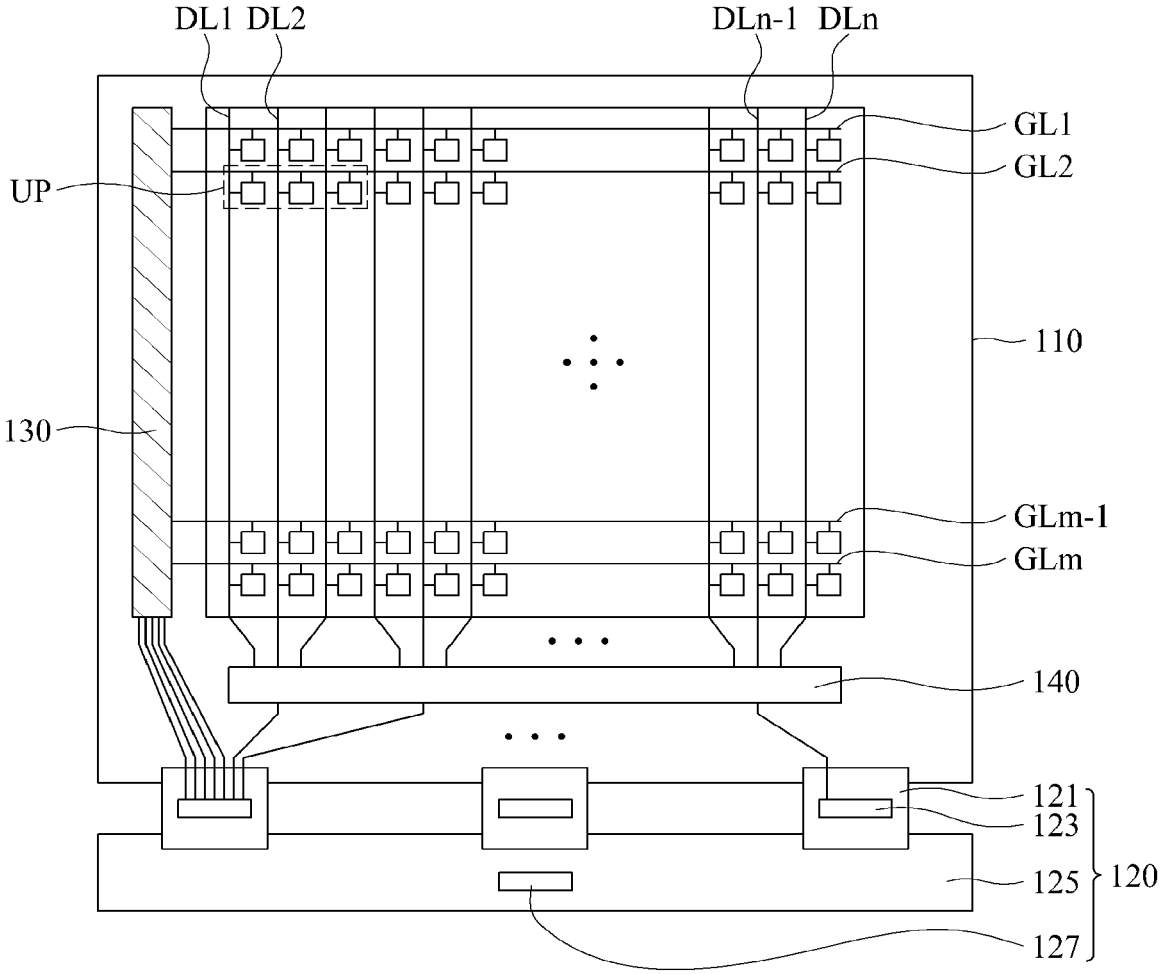
FIG. 1 is a plane view illustrating a display apparatus according to one aspect of the present disclosure.

Advantages and features of the present disclosure, and implementation methods thereof will be clarified through following aspects described with reference to the accompanying drawings. The present disclosure may, however, be embodied in different forms and should not be construed as limited to the aspects set forth herein. Rather, these aspects are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing aspects of the present disclosure are merely an example, and thus, the present disclosure is not limited to the illustrated details. Like reference numerals refer to like elements throughout the specification. In the following description, when the detailed description of the relevant known function or configuration is determined to unnecessarily obscure the important point of the present disclosure, the detailed description will be omitted. In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when the position relationship is described as 'upon~', 'above~', 'below~', and 'next to~', one or more portions may be arranged between two other portions unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing elements of the present disclosure, the terms "first", "second", etc. may be used. These terms are intended to identify the corresponding elements from the other elements, and basis, order, or the number of the corresponding elements is not limited by these terms. The expression that an element is "connected" or "coupled" to another element should be understood that the element may directly be connected or coupled to another element but may directly be connected or coupled to another element unless specially mentioned, or a third element may be interposed between the corresponding elements.

Therefore, the display apparatus of the present disclosure may comprise a display apparatus of a narrow meaning such as a liquid crystal module (LCM) or an organic light emitting display module (OLED), and may comprise a set apparatus which is an application product or a final consumer product including an LCM, an OLED module, etc.

For example, if the display panel is an OLED display panel, the display panel may include a plurality of gate and data lines, and pixels formed in crossing areas of the gate lines and the data lines. Also, the display panel may include an array substrate including a thin film transistor which is an element for selectively applying a voltage to each pixel, an organic light emitting diode (OLED) layer on the array substrate, and an encapsulation substrate arranged on the array substrate to cover the OLED layer. The encapsulation substrate may protect the thin film transistor and the OLED layer from external impact, and may prevent water or oxygen from being permeated into the OLED layer. The layer formed on the array substrate may include an inorganic light emitting layer, for example, nano-sized material layer or quantum dot.

Features of various aspects of the present disclosure may be partially or overall coupled to or combined with each other, and may be variously inter-operated with each other and driven technically as those skilled in the art can sufficiently understand. The aspects of the present disclosure may be carried out independently from each other, or may be carried out together in co-dependent relationship.

Hereinafter, the aspects of the present disclosure will be described with reference to the accompanying drawings and examples.

FIG. 1 is a plane view illustrating a display apparatus according to one aspect of the present disclosure.

Referring to FIG. 1, the display apparatus comprises a substrate 110, a data driving circuit portion 120, a scan driving circuit portion 130, and a demultiplexing circuit portion 140.

The substrate 110 may be made of glass or plastic. According to one example, the substrate 110 may be made of a transparent plastic having flexible characteristic, for example, polyimide.

The substrate 110 includes a plurality of pixels provided by crossing of n data lines DL1 to DLn and m gate lines GL1 to GLm. One pixel may include red subpixels, green subpixels, and blue subpixels, and adjacent red, green and blue subpixels may constitute one unit pixel UP.

The data driving circuit portion 120 may include a plurality of circuit films 121, a plurality of driving integrated circuits 123, a printed circuit board 125, and a timing controller 127.

Each of the plurality of circuit films 121 may be attached between a pad portion of the substrate 110 and the printed circuit board 125. For example, an input terminal provided at one side of each of the plurality of circuit films 121 may be attached to the printed circuit board 125 by a film attachment process, and an output terminal provided at the other side of each of the plurality of circuit films 121 may be attached to the pad portion of the substrate 110 by a film attachment process.

Each of the plurality of driving integrated circuits 123 may be packaged in each of the plurality of circuit films 121. Each of the plurality of driving integrated circuits 123 may receive a data control signal and pixel data supplied from the timing controller 127, convert the pixel data to an analog type data signal per pixel in accordance with the data control signal and supply the converted data signal to a corresponding data line.

The printed circuit board 125 may support the timing controller 127 and may transfer signals and power sources between elements of the data driving circuit portion 120.

The timing controller 127 may be packaged in the printed circuit board 125, and may receive image data and a timing synchronization signal supplied from a display driving system through a user connector provided in the printed circuit board 125. The timing controller 127 may generate each of a data control signal and a scan control signal based on the timing synchronization signal, control a driving timing of each of the driving integrated circuits 123 through the data control signal and control a driving timing of the scan driving circuit portion through the scan control signal.

The scan driving circuit portion 130 may be arranged at one side corner of the substrate 110 to be connected to each of the m gate lines GL1 to GLm. At this time, the scan driving circuit portion 130 may be formed together with a manufacturing process of a thin film transistor of each pixel. The scan driving circuit portion 130 may generate scan pulses in accordance with the gate control signal supplied from the driving integrated circuit 123 and sequentially supply the scan pulses to each of the m gate lines GL1 to GLm. According to one example, the scan driving circuit portion 130 may include m stages (not shown) respectively connected to the m gate lines GL1 to GLm.

The demultiplexing circuit portion 140 may sequentially supply the data signals supplied from the data driving circuit portion 120 to at least two data lines DL. In detail, the demultiplexing circuit portion 140 may be arranged at one side of the substrate 110 to be connected to each of output channels CH of the driving integrated circuit 123 and to be electrically connected to each of the n data lines DL1 to DLn provided in the substrate 110. The demultiplexing circuit portion 140 may sequentially distribute the data signals input per a plurality of sub horizontal periods of one horizontal period from the driving integrated circuit 123 to the n data lines DL1 to DLn.

According to one example, if the demultiplexing circuit portion 140 is connected to i control lines (i is a natural number of 2 or more) and connected to n data lines DL, the plurality of driving integrated circuits 123 of the data driving circuit portion 120 may have n/i output channels. Therefore, as the display apparatus includes the demultiplexing circuit portion 140 connected to the i control lines, the number of channels of the plurality of driving integrated circuits 123 may be reduced and at the same time image of high resolution may be embodied.

Figure 2:
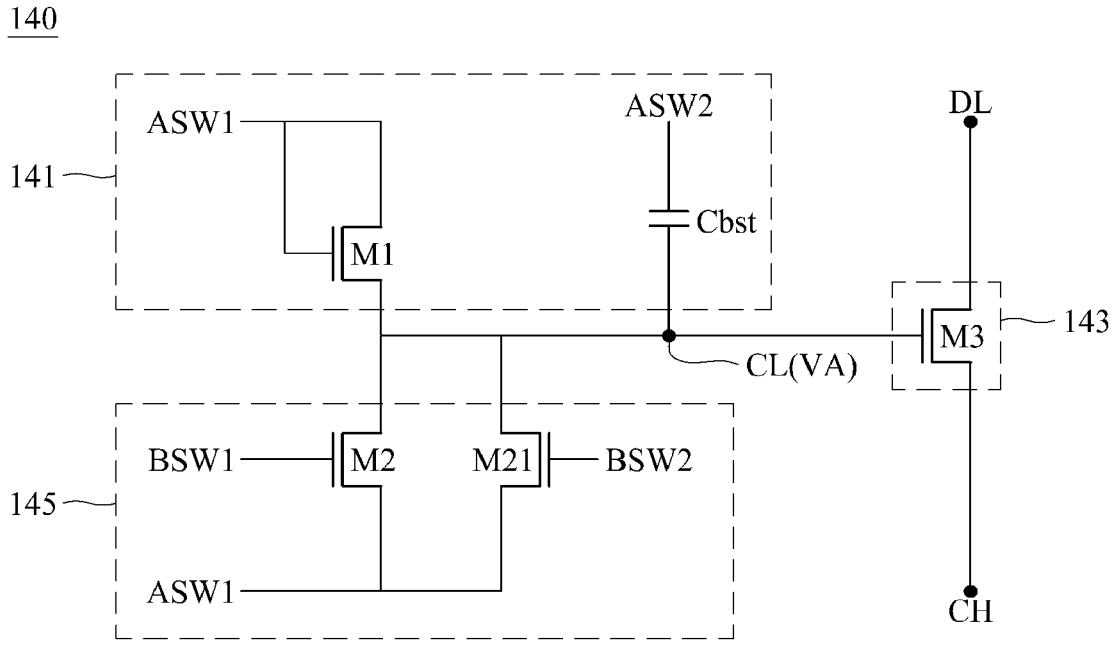
FIG. 2 is a circuit view briefly illustrating an example of a demultiplexing circuit portion shown in FIG. 1.

FIG. 2 is a circuit view briefly illustrating an example of the demultiplexing circuit portion 140 shown in FIG. 1.

Referring to FIG. 2, the demultiplexing circuit portion 140 may include a voltage controller 141, a switching portion 143 and a voltage discharge portion 145.

The voltage controller 141 may control a voltage VA of a control line CL in response to time-division control signals ASW1 and BSW1. The voltage controller 141 may more increase the voltage VA of the control line CL based on auxiliary signals ASW2 and BSW2 partially overlapping the time-division control signals ASW1 and BSW1. For example, the voltage controller 141 may drive the voltage of the control line CL at a voltage higher than those of the time-division control signals ASW1 and BSW1 by bootstrapping the voltage VA of the control line CL based on the auxiliary signals ASW2 and BSW2, whereby the output of the demultiplexing circuit portion 140 may stably be maintained.

The voltage controller 141 may include a first transistor M1 and a capacitor Cbst.

The first transistor M1 may be turned on based on the first time-division control signal ASW1 to supply the first time-division control signal ASW1 to the control line CL. In detail, a drain electrode and a gate electrode of the first transistor M1 may receive the first time-division control signal ASW1, and a source electrode of the first transistor M1 may be connected with the control line CL. Therefore, if the first time-division control signal ASW1 corresponds to a high potential voltage, the voltage VA of the control line CL may maintain the high potential voltage.

The capacitor Cbst may more increase the voltage VA of the control line CL based on the first auxiliary signal ASW2 partially overlapped with the first time-division control signal ASW1. In detail, one end of the capacitor Cbst may receive the first auxiliary signal ASW2, and the other end of the capacitor Cbst may be connected with the control line CL. In this case, a first transition time period of the first auxiliary signal ASW2 may correspond to a time period between a first transition time period and a second transition time period of the first time-division control signal ASW1. That is, after the first time-division control signal ASW1 is applied to the drain electrode and the gate electrode of the first transistor M1, the first auxiliary signal ASW2 may be applied to one end of the capacitor Cbst. In this way, after the first transistor M1 is turned on based on the first time-division control signal ASW1 to supply the first time-division control signal ASW1 to the control line CL, the capacitor Cbst performs bootstrapping for the voltage VA of the control line CL based on the first auxiliary signal ASW2, whereby the voltage controller 141 may stably maintain the output of the demultiplexing circuit portion 140. Meanwhile, if supply of the first auxiliary signal ASW2 supplied to one end of the capacitor Cbst is stopped, the voltage VA of the control line CL may return to a voltage prior to bootstrapping.

The switching portion 143 may supply the data signal supplied from the data driving circuit portion 120 to at least two data lines DL based on the voltage VA of the control line CL in due order. The switching portion 143 may include a third transistor M3.

The third transistor M3 may be turned on based on the voltage VA of the control line CL to sequentially supply the data signals received from an output channel CH of the driving integrated circuit 123 to at least two data lines DL. In detail, a gate electrode of the third transistor M3 may be connected with the control line CL, a drain electrode of the third transistor M3 may be connected with the output channel CH of the driving integrated circuit 123, and a source electrode of the third transistor M3 may be connected with the data line DL. Therefore, the third transistor M3 may be turned on while the control line CL has a high potential voltage by means of the first time-division control signal ASW1 and is bootstrapped by the first auxiliary signal ASW2, thereby sequentially supplying the data signals to at least two data lines DL.

According to one example, the third transistor M3 may be turned on from the first transition time period of the first time-division control signal ASW1 to a first transition time period of a second time-division control signal BSW1 spaced apart from the first time-division control signal ASW1, thereby sequentially supplying the data signals to at least two data lines. In detail, since the control line CL is charged by the first transistor M1 from an applying time of the first time-division control signal ASW1 and discharged by the second transistor M2 from an applying time of the second time-division control signal BSW1, the third transistor M3 may be turned on from the first transition time period of the first time-division control signal ASW1 to the first transition time period of the second time-division control signal BSW1.

The voltage discharge portion 145 may discharge the voltage VA of the control line CL in response to the time-division control signals ASW1 and BSW1. The voltage discharge portion 145 may additionally discharge the voltage VA of the control line CL based on the auxiliary signals ASW2 and the BSW2 partially overlapped with the time-division control signals ASW1 and BSW1. For example, the voltage discharge portion 145 primarily discharges the voltage VA of the control line CL based on the time-division control signals ASW1 and BSW1 and then secondarily discharges the voltage VA of the control line CL based on the auxiliary signals ASW2 and BSW2, whereby discharging efficiency of the demultiplexing circuit portion 140 may be improved and therefore an off current transferred to an organic light emitting diode may be prevented from occurring.

The voltage discharge portion 145 may include a second transistor M2 and a discharge transistor M21.

The second transistor M2 may be turned on based on the second time-division control signal BSW1 spaced apart from the first time-division control signal ASW1 to discharge the voltage VA of the control line CL. In detail, a gate electrode of the second transistor M2 may receive the second time-division control signal BSW1, a drain electrode of the second transistor M2 may be connected with the control line CL and a source electrode of the second transistor M2 may receive the first time-division control signal ASW1. At this time, the first time-division control signal ASW1 and the second time-division control signal BSW1 are applied at their respective timings different from each other, if the second time-division control signal BSW1 corresponds to a high potential voltage, the first time-division control signal ASW1 may correspond to a low potential voltage. Therefore, if the second time-division control signal BSW1 of the high potential voltage is applied to the gate electrode of the second transistor M2, the second transistor M2 may be turned on, and since the first time-division control signal ASW1 of the low potential voltage is applied to the source electrode of the second transistor M2, the voltage of the control line CL may be discharged.

The discharge transistor M21 may be turned on based on the second auxiliary signal BSW2 partially overlapped with the second time-division control signal BSW1 to additionally discharge the voltage VA of the control line CL. In detail, a gate electrode of the discharge transistor M21 may receive the second auxiliary signal BSW2, a drain electrode of the discharge transistor M21 may be connected with the control line CL and a source electrode of the discharge transistor M21 may receive the first time-division control signal ASW1. In this case, a first transition time period of the second auxiliary signal BSW2 may correspond to a time period between a first transition time period and a second transition time period of the second time-division control signal BSW1. That is, after the second time-division control signal BSW1 is applied to the gate electrode of the second transistor M2, the second auxiliary signal BSW2 may be applied to the gate electrode of the discharge transistor M21. In this way, after the second transistor M2 primarily discharges the voltage VA of the control line CL based on the second time-division control signal BSW1, the discharge transistor M21 secondarily discharges the voltage VA of the control line CL based on the second auxiliary signal BSW2, whereby the voltage discharge portion 145 may improve discharging efficiency of the demultiplexing circuit portion 140 and therefore prevent an off current transferred to an organic light emitting diode from occurring.

Figure 3:
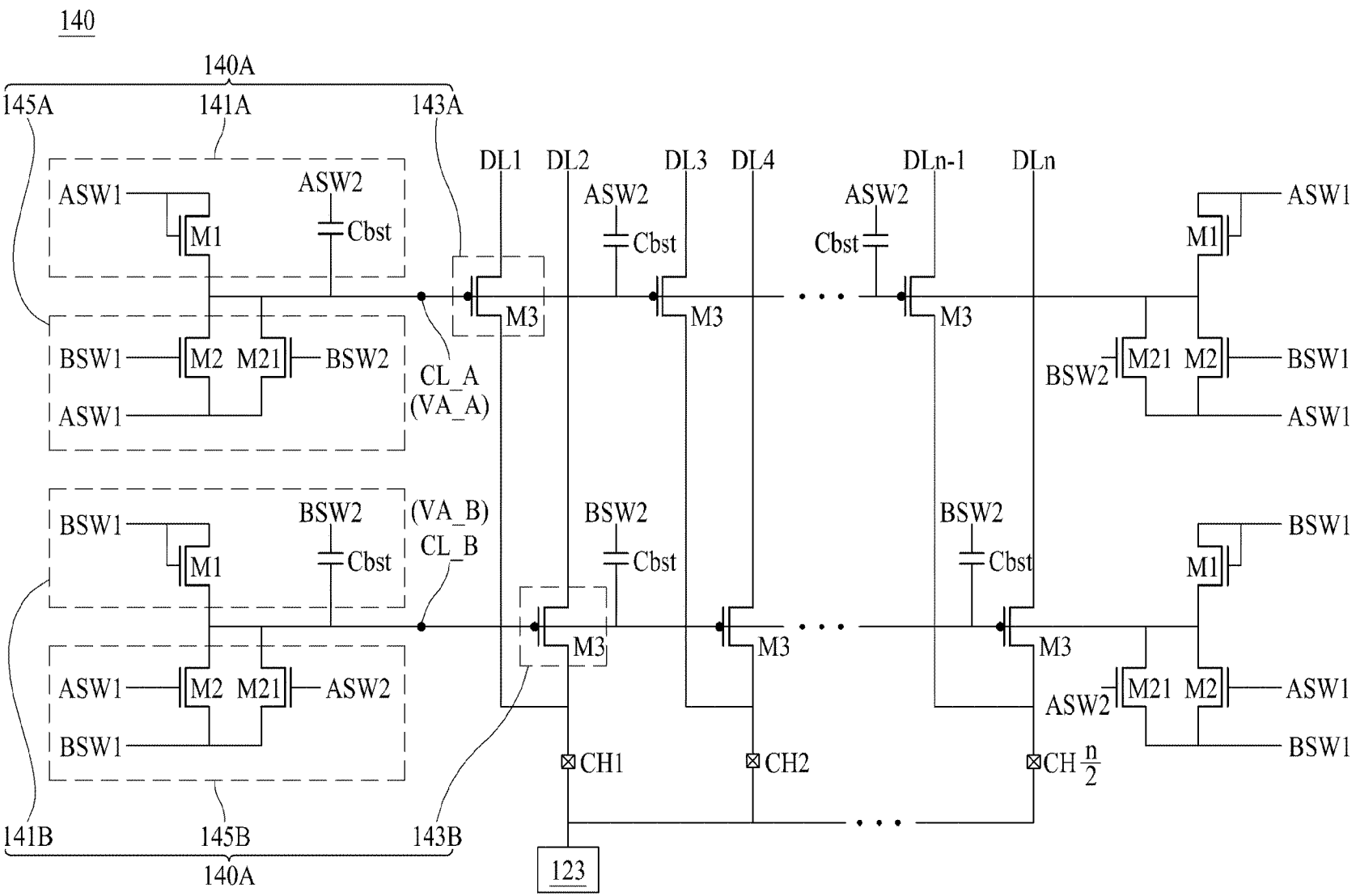
FIG. 3 is a circuit view illustrating that a demultiplexing circuit portion shown in FIG. 2 drives two data lines from one output channel.
Figure 4:
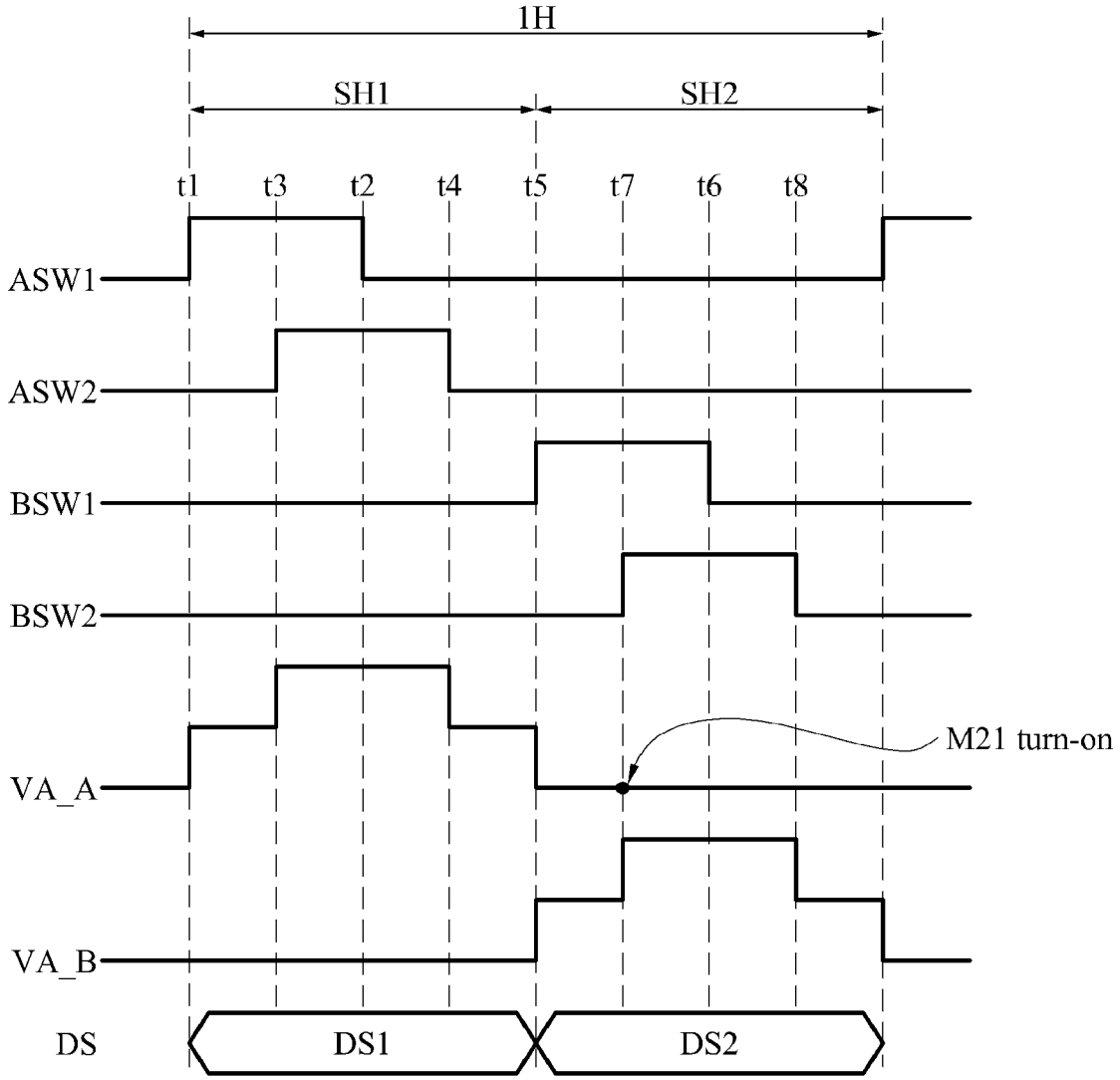
FIG. 4 is a waveform of signals supplied to a demultiplexing circuit portion shown in FIG. 3.

FIG. 3 is a circuit view illustrating that a demultiplexing circuit portion shown in FIG. 2 drives two data lines from one output channel, and FIG. 4 is a waveform of signals supplied to the demultiplexing circuit portion 140 shown in FIG. 3.

Referring to FIGS. 3 and 4, if the demultiplexing circuit portion 140 is connected with two control lines CL_A and CL_B and connected with n data lines DL, the plurality of driving integrated circuits 123 of the data driving circuit portion 120 may have n/2 output channels CH. Therefore, as the display apparatus comprises the demultiplexing circuit portion 140 connected with two control lines CL_A and CL_B, image of high resolution may be embodied while the number of output channels CH of the plurality of driving integrated circuits 123 may be reduced to ½ as compared with the display apparatus that does not comprise the demultiplexing circuit portion 140.

The demultiplexing circuit portion 140 may include a first voltage controller 141A, a first switching portion 143A and a first voltage discharge portion 145A, which are connected with the first control line CL_A, and a second voltage controller 141B, a second switching portion 143B and a second voltage discharge portion 145B, which are connected with the second control line CL_B.

The first transistor M1 of the first voltage controller 141A may be turned on based on the first time-division control signal ASW1 to supply the first time-division control signal ASW1 to the first control line CL_A, and the capacitor Cbst of the first voltage controller 141A may bootstrap a voltage VA_A of the first control line CL_A based on the first auxiliary signal ASW2 partially overlapped with the first time-division control signal ASW1.

The first transistor M1 of the second voltage controller 141B may be turned on based on the second time-division control signal BSW1 to supply the second time-division control signal BSW1 to the second control line CL_B, and the capacitor Cbst of the second voltage controller 141B may bootstrap a voltage VA_B of the second control line CL_B based on the second auxiliary signal BSW2 partially overlapped with the second time-division control signal BSW1.

In this way, the first voltage controller 141A may maintain the voltage VA_A of the first control line CL_A at a high potential voltage for a first sub horizontal period SH1 of one horizontal period 1H, and the second voltage controller 141B may maintain the voltage VA_B of the second control line CL_B at a high potential voltage for a second sub horizontal period SH2 of one horizontal period 1H.

According to one example, a first transition time period t3 of the first auxiliary signal ASW2 may correspond to a time period between a first transition time period t1 and a second transition time period t2 of the first time-division control signal ASW1, and a first transition time period t7 of the second auxiliary signal BSW2 may correspond to a time period between a first transition time period t5 and a second transition time period t7 of the second time-division control signal BSW1. In this case, a first transition time period of each of a plurality of signals may correspond to, but is not limited to, a rising edge, and a second transition time period thereof may correspond to, but is not limited to, a falling edge. Therefore, the voltage VA_A of the first control line CL_A may primarily be increased at the time period t1 when the first time-division control signal ASW1 is applied, and may secondarily be increased by bootstrapping at a time period t3 when the first auxiliary signal ASW2 is applied. Also, the voltage VA_B of the second control line CL_B may primarily be increased at the time period t5 when the second time-division control signal BSW1 is applied, and may secondarily be increased by bootstrapping at a time period t7 when the second auxiliary signal BSW2 is applied. Meanwhile, the voltages VA_A and VA_B of each of the first and second control lines CL_A and CL_B may return to the voltages prior to bootstrapping at the second transition time periods t4 and t8 of each of the first and second auxiliary signals ASW2 and BSW2.

The third transistor M3 of the first switching portion 143A may be turned on based on the voltage VA_A of the first control line CL_A to supply a data signal DS1 supplied from the plurality of output channels CH of the driving integrated circuit 123 to first data lines DL1, DL3, . . . , DLn−1 of two data lines corresponding to each of the plurality of output channels CH.

According to one example, the third transistor M3 of the first switching portion 143A may be turned on from the first transition time period t1 of the first time-division control signal ASW1 to the first transition time period t5 of the second time-division control signal BSW1 to supply the data signal DS1 to the first data lines DL1, DL3, . . . , DLn−1 of two data lines DL. In detail, since the control line CL is charged by the first transistor M1 from an applying time period t1 of the first time-division control signal ASW1 and discharged by the second transistor M2 from an applying time period t5 of the second time-division control signal BSW1, the third transistor M3 may be turned on from the first transition time period t1 of the first time-division control signal ASW1 to the first transition time period t5 of the second time-division control signal BSW1.

The third transistor M3 of the second switching portion 143B may be turned on based on the voltage VA_B of the second control line CL_B to supply a data signal DS2 supplied from the plurality of output channels CH of the driving integrated circuit 123 to second data lines DL2, DL4, . . . , DLn of two data lines corresponding to each of the plurality of output channels CH.

In this way, the first switching portion 143A may be turned on for the first sub horizontal period SH1 of one horizontal period 1H to supply the data signal DS1 to the first data lines DL1, DL3, . . . , DLn−1 of two data lines DL corresponding to each of the plurality of output channels CH, and the second switching portion 143B may be turned on for the second sub horizontal period SH2 of one horizontal period 1H to supply the data signal DS2 to the second data lines DL2, DL4, . . . , DLn of two data lines DL corresponding to each of the plurality of output channels CH. Therefore, as the display apparatus comprises the demultiplexing circuit portion 140 connected with two control lines CL_A and CL_B, image of high resolution may be embodied while the number of output channels CH of the plurality of driving integrated circuits 123 may be reduced to ½ as compared with the display apparatus that does not comprise the demultiplexing circuit portion 140.

The second transistor M2 of the first voltage discharge portion 145A may be turned on based on the second time-division control signal BSW1 spaced apart from the first time-division control signal ASW1 to discharge the voltage VA_A of the first control line CL_A, and the discharge transistor M21 of the first voltage discharge portion 145A may be turned on based on the second auxiliary signal BSW2 partially overlapped with the second time-division control signal BSW1 to additionally discharge the voltage VA_B of the second control line CL_B.

The second transistor M2 of the second voltage discharge portion 145B may be turned on based on the first time-division control signal ASW1 spaced apart from the second time-division control signal BSW1 to discharge the voltage VA_B of the second control line CL_B, and the discharge transistor M21 of the second voltage discharge portion 145B may be turned on based on the first auxiliary signal ASW2 partially overlapped with the first time-division control signal ASW1 to additionally discharge the voltage VA_B of the second control line CL_B.

As described above, the second transistor M2 of the first voltage discharge portion 145A may be turned on at time period t5 when the first sub horizontal period SH1 of one horizontal period 1H ends or the second sub horizontal period SH2 starts, to primarily discharge the voltage VA_A of the first control line CL_A. Also, the discharge transistor M21 of the first voltage discharge portion 145A may be turned on at the time period t7 when the second auxiliary signal BSW2 is applied after the first sub horizontal period SH1 of one horizontal period 1H ends, to secondarily discharge the voltage VA_A of the first control line CL_A. Therefore, as the demultiplexing circuit portion 140 includes the discharge transistor M21, the demultiplexing circuit portion 140 may improve discharging efficiency of the voltage VA of the control line CL even in the case that the second transistor M2 is degraded, and may prevent an off current transferred to an organic light emitting diode from occurring. As a result, the demultiplexing circuit portion 140 may stably maintain the output of the third transistor M3 turned on based on the voltage VA of the control line CL, whereby luminance of the display panel may be prevented from being deteriorated and image of high resolution of the display panel may be embodied.

According to one example, the first transistor M1 of the voltage controller 141 and the second transistor M2 and the discharge transistor M21 of the voltage discharge portion 145 may be arranged at each of both ends of the control line CL, and one control line CL may be connected with a plurality of capacitors Cbst and a plurality of switching portions 143. In this way, the first transistor M1 and the second transistor M2 arranged at each of both ends of the control line CL may turn on or turn off the plurality of switching portions 143 connected with the control line CL by charging or discharging the voltage VA of the control line CL. At this time, as the voltage discharge portion 145 includes the discharge transistor M21 for additionally discharging the voltage VA of the control line CL, discharging efficiency of the voltage VA of the control line CL may be improved.

Figure 5:
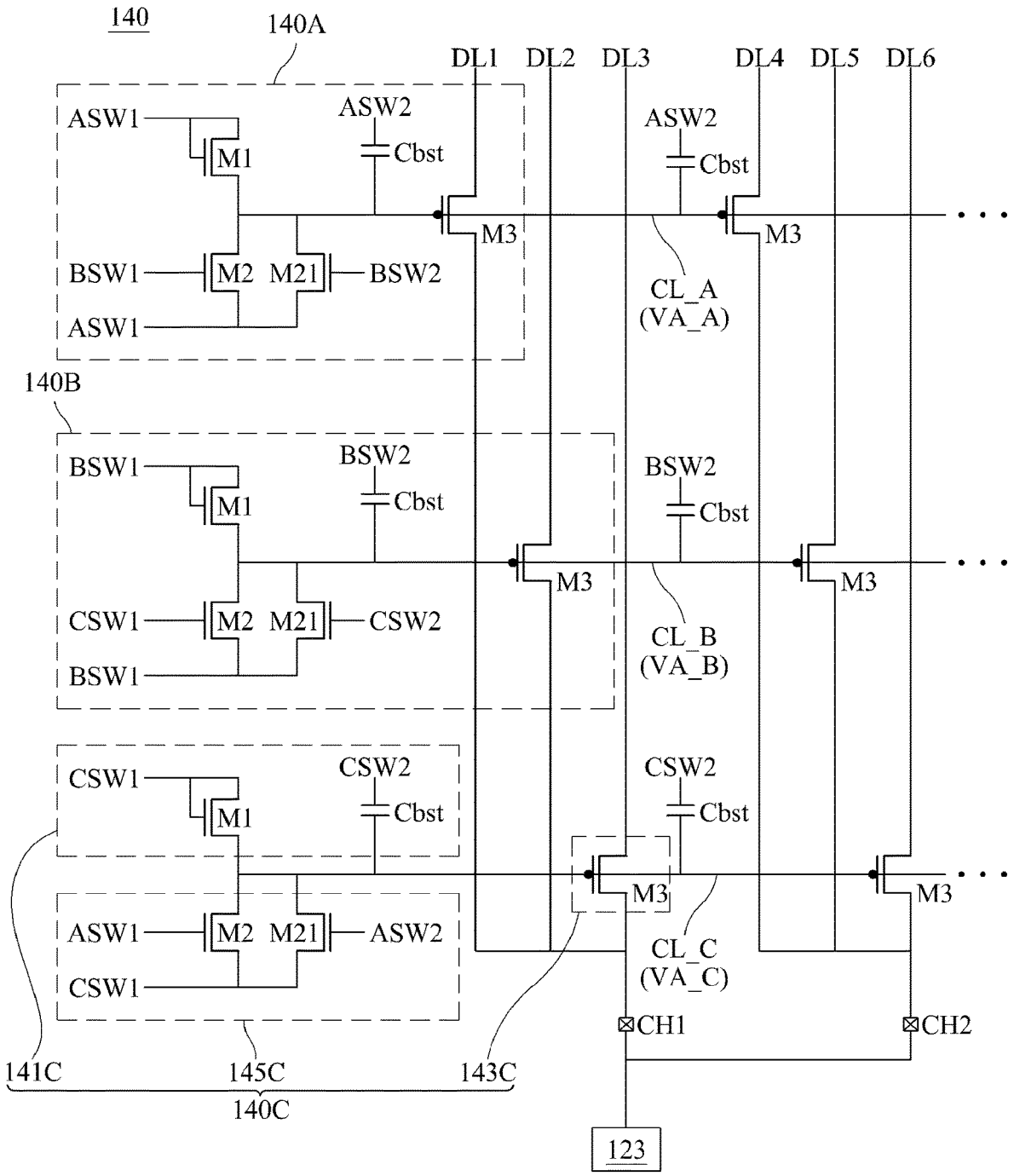
FIG. 5 is a circuit view illustrating that a demultiplexing circuit portion shown in FIG. 2 drives three data lines from one output channel.
Figure 6:
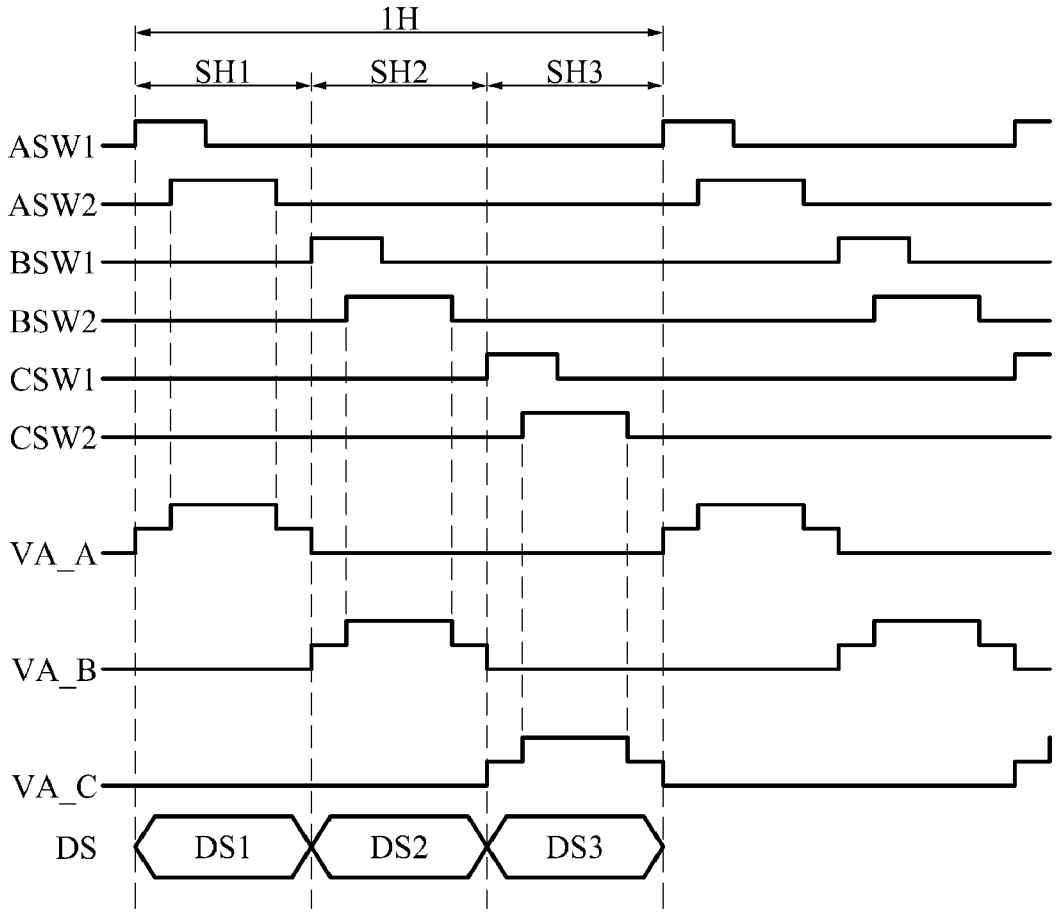
FIG. 6 is a waveform of signals supplied to a demultiplexing circuit portion shown in FIG. 5.

FIG. 5 is a circuit view illustrating that the demultiplexing circuit portion shown in FIG. 2 drives three data lines from one output channel, and FIG. 6 is a waveform of signals supplied to the demultiplexing circuit portion shown in FIG. 5.

Referring to FIGS. 5 and 6, if the demultiplexing circuit portion 140 is connected with three control lines CL_A, CL_B and CL_C and connected with n data lines DL, the plurality of driving integrated circuits 123 of the data driving circuit portion 120 may have n/3 output channels CH. Therefore, as the display apparatus comprises the demultiplexing circuit portion 140 connected with three control lines CL_A, CL_B and CL_C, image of high resolution may be embodied while the number of output channels CH of the plurality of driving integrated circuits 123 may be reduced to ⅓ as compared with the display apparatus that does not comprise the demultiplexing circuit portion 140.

The demultiplexing circuit portion 140 may include a first voltage controller 141A, a first switching portion 143A and a first voltage discharge portion 145A, which are connected with the first control line CL_A, a second voltage controller 141B, a second switching portion 143B and a second voltage discharge portion 145B, which are connected with the second control line CL_B, and a third voltage controller 141C, a third switching portion 143C and a third voltage discharge portion 145C, which are connected with the third control line CL_C.

The first transistor M1 of the first voltage controller 141A may be turned on based on the first time-division control signal ASW1 to supply the first time-division control signal ASW1 to the first control line CL_A, and the capacitor Cbst of the first voltage controller 141A may bootstrap a voltage VA_A of the first control line CL_A based on the first auxiliary signal ASW2 partially overlapped with the first time-division control signal ASW1.

The first transistor M1 of the second voltage controller 141B may be turned on based on the second time-division control signal BSW1 to supply the second time-division control signal BSW1 to the second control line CL_B, and the capacitor Cbst of the second voltage controller 141B may bootstrap a voltage VA_B of the second control line CL_B based on the second auxiliary signal BSW2 partially overlapped with the second time-division control signal BSW1.

The first transistor M1 of the third voltage controller 141C may be turned on based on the third time-division control signal CSW1 to supply the third time-division control signal CSW1 to the third control line CL_C, and the capacitor Cbst of the third voltage controller 141C may bootstrap a voltage VA_C of the third control line CL_C based on a third auxiliary signal CSW2 partially overlapped with the third time-division control signal CSW1.

In this way, the first voltage controller 141A may maintain the voltage VA_A of the first control line CL_A at a high potential voltage for the first sub horizontal period SH1 of one horizontal period 1H, the second voltage controller 141B may maintain the voltage VA_B of the second control line CL_B at a high potential voltage for the second sub horizontal period SH2 of one horizontal period 1H, and the third voltage controller 141C may maintain the voltage VA_C of the third control line CL_C at a high potential voltage for a third sub horizontal period SH3 of one horizontal period 1H.

The third transistor M3 of the first switching portion 143A may be turned on based on the voltage VA_A of the first control line CL_A to supply a data signal DS1 supplied from the plurality of output channels CH of the driving integrated circuit 123 to first data lines DL1, DL4, . . . , DLn−2 of three data lines DL corresponding to each of the plurality of output channels CH.

The third transistor M3 of the second switching portion 143B may be turned on based on the voltage VA_B of the second control line CL_B to supply a data signal DS2 supplied from the plurality of output channels CH of the driving integrated circuit 123 to second data lines DL2, DL5, . . . , DLn−1 of three data lines DL corresponding to each of the plurality of output channels CH.

The third transistor M3 of the third switching portion 143C may be turned on based on the voltage VA_C of the third control line CL_C to supply a data signal DS3 supplied from the plurality of output channels CH of the driving integrated circuit 123 to third data lines DL3, DL6, . . . , DLn of three data lines DL corresponding to each of the plurality of output channels CH.

In this way, the first switching portion 143A may be turned on for the first sub horizontal period SH1 of one horizontal period 1H to supply the data signal DS1 to the first data lines DL1, DL4, . . . , DLn−2 of three data lines DL corresponding to each of the plurality of output channels CH, the second switching portion 143B may be turned on for the second sub horizontal period SH2 of one horizontal period 1H to supply the data signal DS2 to the second data lines DL2, DL5, . . . , DLn−1 of three data lines DL corresponding to each of the plurality of output channels CH, and the third switching portion 143C may be turned on for the third sub horizontal period SH3 of one horizontal period 1H to supply the data signal DS3 to the third data lines DL3, DL6, . . . , DLn of three data lines DL corresponding to each of the plurality of output channels CH. Therefore, as the display apparatus comprises the demultiplexing circuit portion 140 connected with three control lines CL_A, CL_B and CL_C, image of high resolution may be embodied while the number of output channels CH of the plurality of driving integrated circuits 123 may be reduced to ⅓ as compared with the display apparatus that does not comprise the demultiplexing circuit portion 140.

The second transistor M2 of the first voltage discharge portion 145A may be turned on based on the second time-division control signal BSW1 spaced apart from the first time-division control signal ASW1 to discharge the voltage VA_A of the first control line CL_A, and the discharge transistor M21 of the first voltage discharge portion 145A may be turned on based on the second auxiliary signal BSW2 partially overlapped with the second time-division control signal BSW1 to additionally discharge the voltage VA_B of the second control line CL_B.

The second transistor M2 of the second voltage discharge portion 145B may be turned on based on the third time-division control signal CSW1 spaced apart from the second time-division control signal BSW1 to discharge the voltage VA_B of the second control line CL_B, and the discharge transistor M21 of the second voltage discharge portion 145B may be turned on based on the third auxiliary signal CSW2 partially overlapped with the third time-division control signal CSW1 to additionally discharge the voltage VA_B of the second control line CL_B.

The second transistor M2 of the third voltage discharge portion 145C may be turned on based on the first time-division control signal ASW1 spaced apart from the third time-division control signal CSW1 to discharge the voltage VA_C of the third control line CL_C, and the discharge transistor M21 of the third voltage discharge portion 145C may be turned on based on the first auxiliary signal ASW2 partially overlapped with the first time-division control signal ASW1 to additionally discharge the voltage VA_C of the third control line CL_C.

Therefore, as the demultiplexing circuit portion 140 includes the discharge transistor M21, the demultiplexing circuit portion 140 may improve discharging efficiency of the voltage VA of the control line CL even in the case that the second transistor M2 is degraded, and may prevent an off current transferred to an organic light emitting diode from occurring. As a result, the demultiplexing circuit portion 140 may stably maintain the output of the third transistor M3 turned on based on the voltage VA of the control line CL, whereby luminance of the display panel may be prevented from being deteriorated and image of high resolution of the display panel may be embodied.

Figure 7:
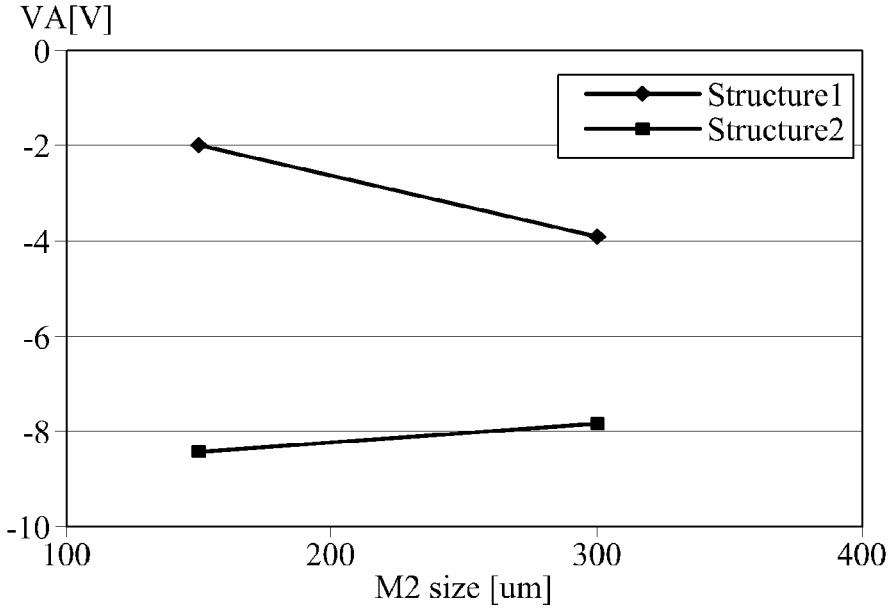
FIG. 7 is a graph illustrating a discharging effect of a demultiplexing circuit portion shown in FIG. 2.

FIG. 7 is a graph illustrating a discharging effect of the demultiplexing circuit portion shown in FIG. 2. In detail, FIG. 7 is a graph illustrating a voltage VA of a discharged control line CL with respect to a size of the second transistor M2. A gate low voltage VGL of the discharged control line CL corresponds to −10V. In this case, Structure 1 corresponds to the demultiplexing circuit portion 140 which does not include a discharge transistor M21, and Structure 2 corresponds to a demultiplexing circuit portion 140 according to the present disclosure.

Referring to FIG. 7, if a size of the second transistor M2 of the Structure 1 is 150 μm, the voltage VA of the discharged control line CL corresponds to −2V, approximately, and if a size of the second transistor M2 of the Structure 2 is 150 μm, the voltage VA of the discharged control line CL corresponds to −8.5V, approximately. That is, as the Structure 2 includes the discharge transistor M21, it is noted that discharging efficiency of the control line CL is improved.

Also, if a size of the second transistor M2 of the Structure 1 is 300 μm, the voltage VA of the discharged control line CL corresponds to −4V, approximately, and if a size of the second transistor M2 of the Structure 2 is 300 μm, the voltage VA of the discharged control line CL corresponds to −7.8V, approximately. That is, as the Structure 2 includes the discharge transistor M21, it is noted that discharging efficiency of the control line CL is improved.

As described above, after the demultiplexing circuit portion 140 primarily discharges the voltage VA of the control line CL based on the second time-division control signal BSW1, the discharge transistor M21 secondarily discharges the voltage VA of the control line CL based on the second auxiliary signal BSW2, whereby the voltage discharge portion 145 may improve discharging efficiency of the demultiplexing circuit portion 140 and therefore prevent an off current transferred to an organic light emitting diode from occurring.

Figure 8:
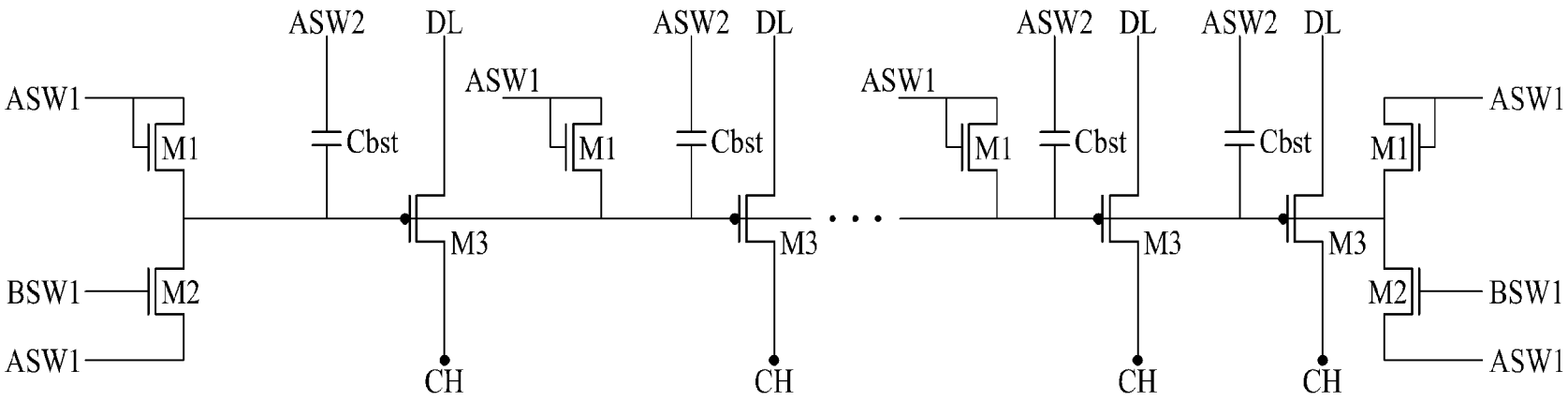
FIG. 8 is a circuit view illustrating another example of a demultiplexing circuit portion shown in FIG. 2.

FIG. 8 is a circuit view illustrating another example of the demultiplexing circuit portion shown in FIG. 2.

Referring to FIG. 8, the demultiplexing circuit portion 140 may include two first transistors M1 and two second transistors M2, which are arranged at each of both ends of one control line CL, wherein one control line CL may be connected with a plurality of capacitors Cbst and a plurality of third transistors M3. At this time, the two first transistors M1 arranged at each of both ends of one control line CL may charge the voltage VA of the control line CL, and the two second transistors M2 arranged at each of both ends of one control line CL may discharge the voltage VA of the control line CL. Each of the plurality of capacitors Cbst may be arranged to correspond to each of the plurality of third transistors M3, whereby the voltage VA of the control line CL may be subjected to bootstrapping.

The voltage controller 141 of the demultiplexing circuit portion 140 may further include p number of first transistors M1 (p is a natural number of 1 to (n/i−2)) turned on based on a kth time-division control signal to supply the kth time-division control signal to a kth control line. In detail, the voltage controller 141 may include additional first transistor M1 separately from the two first transistors M1 arranged at each of both ends of one control line CL, whereby charging efficiency of the control line CL may be improved and therefore the voltage of the control line CL may stably be maintained.

According to one example, the voltage controller 141 of the demultiplexing circuit portion 140 may further include a first transistor M1 by grouping a plurality of capacitors Cbst and a plurality of third transistors M3 in a predetermined unit to correspond to each of the plurality of groups. For example, if the display apparatus includes n data lines DL1 to DLn and the demultiplexing circuit portion 140 is connected with three control lines CL_A, CL_B and CL_C, since one control line CL is connected with n/3 data lines DL, the demultiplexing circuit portion 140 may include n/3 third transistors M3 connected with one control line CL. At this time, the demultiplexing circuit portion 140 may further include n/30 first transistors M1 by grouping a plurality of capacitors Cbst and a plurality of third transistors M3 in a unit of 10 capacitors Cbst and 10 third transistors M3. In this way, the voltage controller 141 of the demultiplexing circuit portion 140 may further include a first transistor M1 corresponding to each of a plurality of groups of a plurality of capacitors Cbst and a plurality of third transistors M3, whereby charging efficiency may be improved in all areas of the control line CL and therefore the voltage of the control line CL may stably be maintained.

According to another example, the voltage controller 141 of the demultiplexing circuit portion 140 may include a first transistor M1 corresponding to each of a plurality of capacitors Cbst and a plurality of third transistors M3. For example, if the display apparatus includes n data lines DL1 to DLn and the demultiplexing circuit portion 140 is connected with three control lines CL_A, CL_B and CL_C, since one control line CL is connected with n/3 data lines DL, the voltage controller 141 of the demultiplexing circuit portion 140 may include n/3 first transistors M1 including a first transistor M1 arranged at each of both ends of the control line CL.

The description of the demultiplexing circuit portion 140 according to one example and another example is only exemplary, and is not limited to the number of the transistors. Therefore, the voltage controller 141 of the demultiplexing circuit portion 140 may improve charging efficiency in all areas of the control line CL and control the number of the first transistors M1 within the range that does not need excessive cost.

Figure 9:
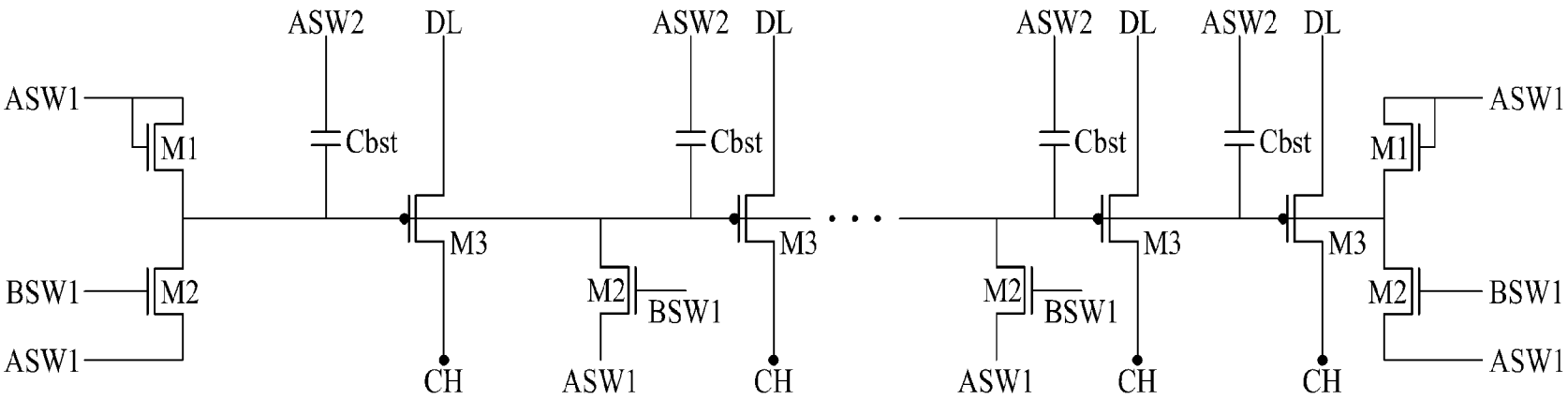
FIG. 9 is a circuit view illustrating still another example of a demultiplexing circuit portion shown in FIG. 2.

FIG. 9 is a circuit view illustrating still another example of the demultiplexing circuit portion shown in FIG. 2.

Referring to FIG. 9, the demultiplexing circuit portion 140 may include two first transistors M1 and two second transistors M2, which are arranged at each of both ends of one control line CL, wherein one control line CL may be connected with a plurality of capacitors Cbst and a plurality of third transistors M3. At this time, the two first transistors M1 arranged at each of both ends of one control line CL may charge the voltage VA of the control line CL, and the two second transistors M2 arranged at each of both ends of one control line CL may discharge the voltage VA of the control line CL. Each of the plurality of capacitors Cbst may be arranged to correspond to each of the plurality of third transistors M3, whereby the voltage VA of the control line CL may be subjected to bootstrapping.

The voltage discharge portion 145 of the demultiplexing circuit portion 140 may further include p number of second transistors M2 (p is a natural number of 1 to (n/i−2)) turned on based on a k+1th time-division control signal to discharge a kth control line CL. In detail, the voltage discharge portion 145 may include additional second transistor M2 separately from the two second transistors M2 arranged at each of both ends of one control line CL, whereby discharging efficiency of the control line CL may be improved and therefore an off current transferred to an organic light emitting diode may be prevented from occurring.

According to one example, the voltage discharge portion 145 of the demultiplexing circuit portion 140 may further include a second transistor M2 by grouping a plurality of capacitors Cbst and a plurality of third transistors M3 in a predetermined unit to correspond to each of the plurality of groups. For example, if the display apparatus includes n data lines DL1 to DLn and the demultiplexing circuit portion 140 is connected with three control lines CL_A, CL_B and CL_C, since one control line CL is connected with n/3 data lines DL, the demultiplexing circuit portion 140 may include n/3 third transistors M3 connected with one control line CL. At this time, the demultiplexing circuit portion 140 may further include n/30 second transistors M2 by grouping a plurality of capacitors Cbst and a plurality of third transistors M3 in a unit of 10 capacitors Cbst and 10 third transistors M3. In this way, the voltage discharge portion 145 of the demultiplexing circuit portion 140 may further include a second transistor M2 corresponding to a plurality of groups of a plurality of capacitors Cbst and a plurality of third transistors M3, whereby discharging efficiency may be improved in all areas of the control line CL to overcome a limitation caused by degradation of the second transistor M2 and therefore an off current capable of being transferred to an organic light emitting diode may be prevented from occurring.

According to another example, the voltage discharge portion 145 of the demultiplexing circuit portion 140 may include a second transistor M2 corresponding to each of a plurality of capacitors Cbst and a plurality of third transistors M3. For example, if the display apparatus includes n data lines DL1 to DLn and the demultiplexing circuit portion 140 is connected with three control lines CL_A, CL_B and CL_C, since one control line CL is connected with n/3 data lines DL, the voltage discharge portion 145 of the demultiplexing circuit portion 140 may include n/3 second transistors M2 including a second transistor M2 arranged at each of both ends of the control line CL.

The description of the demultiplexing circuit portion 140 according to one example and another example is only exemplary, and is not limited to the number of the transistors. Therefore, the voltage discharge portion 145 of the demultiplexing circuit portion 140 may improve discharging efficiency in all areas of the control line CL and control the number of the second transistors M2 within the range that does not need excessive cost.

Figure 10:
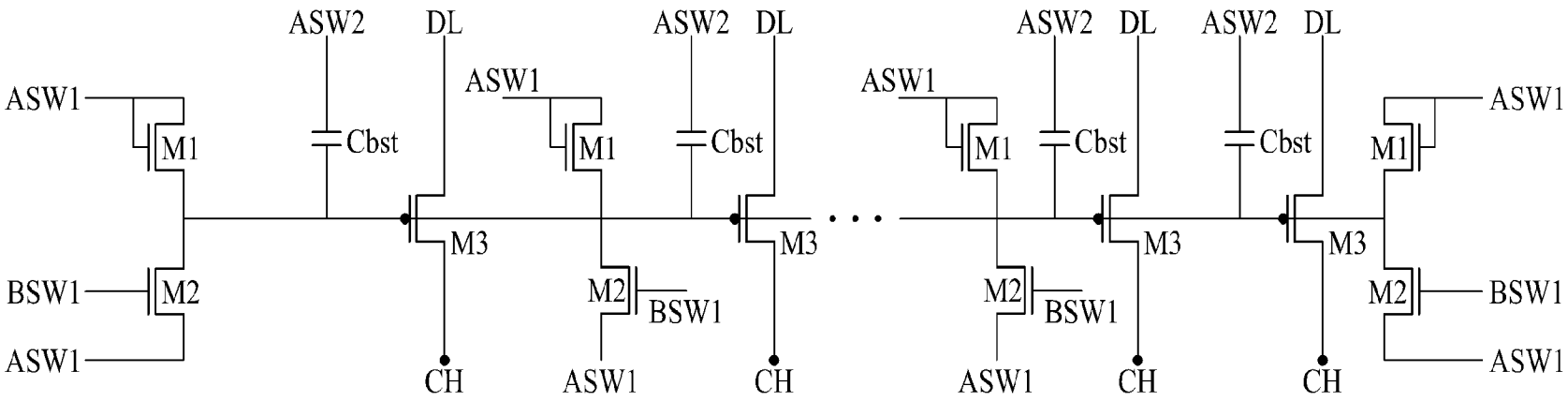
FIG. 10 is a circuit view illustrating further still another example of a demultiplexing circuit portion shown in FIG. 2.

FIG. 10 is a circuit view illustrating further still another example of the demultiplexing circuit portion shown in FIG. 2.

Referring to FIG. 10, the demultiplexing circuit portion 140 may include two first transistors M1 and two second transistors M2, which are arranged at each of both ends of one control line CL, and one control line CL may be connected with a plurality of capacitors Cbst and a plurality of third transistors M3.

The voltage controller 141 may further include p number of first transistors M1 (p is a natural number of 1 to (n/i−2)) turned on based on a kth time-division control signal to supply the kth time-division control signal to a kth control line, and the voltage discharge portion 145 may further include p number of second transistors M2 (p is a natural number of 1 to (n/i−2)) turned on based on a k+1th time-division control signal to discharge a kth control line CL, whereby charging efficiency and discharging efficiency of the control line CL may be improved.

According to one example, the demultiplexing circuit portion 140 may further include a pair of first transistor M1 and second transistor M2 by grouping a plurality of capacitors Cbst and a plurality of third transistors M3 in a predetermined unit to correspond to each of the plurality of groups. For example, if the display apparatus includes n data lines DL1 to DLn and the demultiplexing circuit portion 140 is connected with three control lines CL_A, CL_B and CL_C, since one control line CL is connected with n/3 data lines DL, the demultiplexing circuit portion 140 may include n/3 third transistors M3 connected with one control line CL. At this time, the demultiplexing circuit portion 140 may further include n/30 first and second transistors M1 and M2 in pairs by grouping a plurality of capacitors Cbst and a plurality of third transistors M3 in a unit of 10 capacitors Cbst and 10 third transistors M3. In this way, the demultiplexing circuit portion 140 may further include first and second transistors M1 and M2 corresponding to each of a plurality of groups of a plurality of capacitors Cbst and a plurality of third transistors M3, whereby charging efficiency and discharging efficiency may be improved in all areas of the control line CL to overcome a limitation caused by degradation of the second transistor M2 and therefore an off current capable of being transferred to an organic light emitting diode may be prevented from occurring.

According to another example, the demultiplexing circuit portion 140 may include a pair of first and second transistors M1 and M2 corresponding to each of a plurality of capacitors Cbst and a plurality of third transistors M3. For example, if the display apparatus includes n data lines DL1 to DLn and the demultiplexing circuit portion 140 is connected with three control lines CL_A, CL_B and CL_C, since one control line CL is connected with n/3 data lines DL, the voltage discharge portion 145 of the demultiplexing circuit portion 140 may include n/3 first and second transistors M1 and M2 in pairs including a pair of first and second transistors M1 and M2 arranged at each of both ends of the control line CL.

The description of the demultiplexing circuit portion 140 according to one example and another example is only exemplary, and is not limited to the number of the transistors. Therefore, the demultiplexing circuit portion 140 may improve charging efficiency and discharging efficiency in all areas of the control line CL and control the number of the first and second transistors M1 and M2 within the range that does not need excessive cost.

Figure 11:
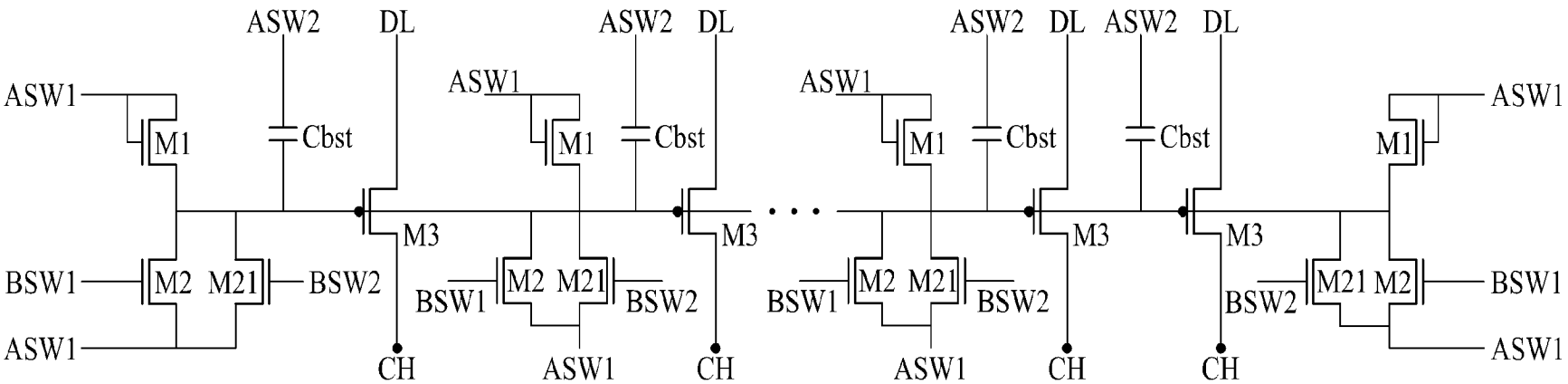
FIG. 11 is a circuit view illustrating further still another example of a demultiplexing circuit portion shown in FIG. 2.

FIG. 11 is a circuit view illustrating further still another example of the demultiplexing circuit portion shown in FIG. 2.

Referring to FIG. 11, the demultiplexing circuit portion 140 may include two first transistors M1 and two second transistors M2, which are arranged at each of both ends of one control line CL, wherein one control line CL may be connected with a plurality of capacitors Cbst and a plurality of third transistors M3.

The voltage controller 141 may further include p number of first transistors M1 (p is a natural number of 1 to (n/i−2)) turned on based on a $k^{th}$ time-division control signal to supply the kth time-division control signal to a kth control line, and the voltage discharge portion 145 may further include p number of second transistors M2 (p is a natural number of 1 to (n/i−2)) turned on based on a $(k+1)^{th}$ time-division control signal to discharge the kth control line CL and the voltage discharge portion 145 further include q number of discharge transistors M21 (q is a natural number of 1 to n/i) for additionally discharging the voltage of the $k^{th}$ control line CL based on a $(k+1)^{th}$ auxiliary signal partially overlapped with the $(k+1)^{th}$ time-division control signal, whereby discharging efficiency may be more improved than the case that the discharge transistor M21 is not provided.

According to one example, the demultiplexing circuit portion 140 may further include a discharge transistor M21 by grouping a plurality of capacitors Cbst and a plurality of third transistors M3 in a predetermined unit to correspond to each of the plurality of groups. For example, if the display apparatus includes n data lines DL1 to DLn and the demultiplexing circuit portion 140 is connected with three control lines CL_A, CL_B and CL_C, since one control line CL is connected with n/3 data lines DL, the demultiplexing circuit portion 140 may include n/3 third transistors M3 connected with one control line CL. At this time, the demultiplexing circuit portion 140 may further include n/30 discharge transistors M21 by grouping a plurality of capacitors Cbst and a plurality of third transistors M3 in a unit of 10 capacitors Cbst and 10 third transistors M3. In this way, the demultiplexing circuit portion 140 may further include discharge transistors M21 corresponding to each of a plurality of groups of a plurality of capacitors Cbst and a plurality of third transistors M3, whereby discharging efficiency of the control line may be more improved than the case that the discharge transistor M21 is not provided, so as to overcome a limitation caused by degradation of the second transistor M2 and therefore an off current capable of being transferred to an organic light emitting diode may be prevented from occurring.

According to another example, the demultiplexing circuit portion 140 may include discharge transistors M21 corresponding to each of a plurality of capacitors Cbst and a plurality of third transistors M3. For example, if the display apparatus includes n data lines DL1 to DLn and the demultiplexing circuit portion 140 is connected with three control lines CL_A, CL_B and CL_C, since one control line CL is connected with n/3 data lines DL, the voltage discharge portion 145 of the demultiplexing circuit portion 140 may include n/3 discharge transistors M21.

According to one example, if the number of the first transistors M1 is equal to the number of the second transistors M2, the demultiplexing circuit portion 140 may divide the kth control line CL into control lines equivalent to the number of the first and second transistors M1 and M2 and charge and discharge the voltage VA of the divided kth control lines CL through a pair of first and second transistors M1 and M2. At this time, the demultiplexing circuit portion 140 may minimize a time constant (t=RC) according to resistor and capacitor connected to the control line CL by dividing the control line CL. Therefore, the demultiplexing circuit portion 140 may enable high speed driving by dividing the control line CL, and may embody image of high resolution while reducing the number of output channels CH.

The description of the demultiplexing circuit portion 140 according to one example and another example is only exemplary, and is not limited to the number of the transistors. Therefore, the demultiplexing circuit portion 140 may more improve discharging effect of the control line CL and control the number of the discharge transistors M21 within the range that does not need excessive cost.

Figure 12:
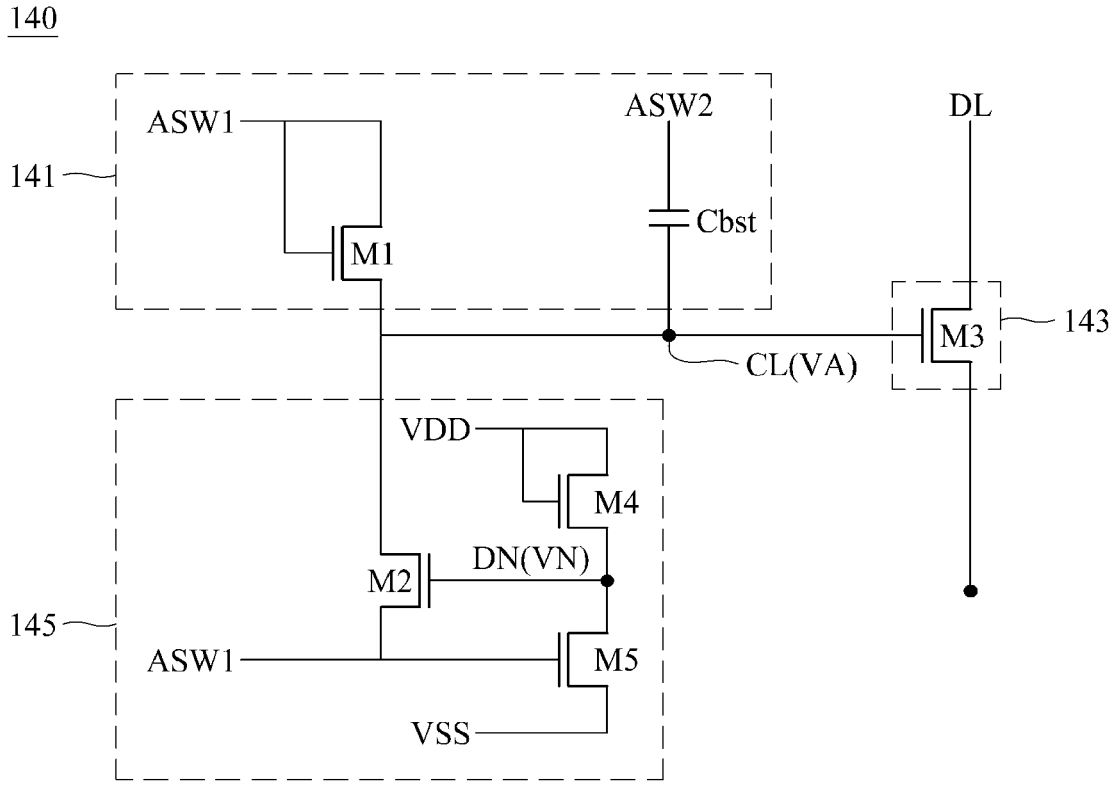
FIG. 12 is a circuit view briefly illustrating another example of a demultiplexing circuit portion shown in FIG. 1.

FIG. 12 is a circuit view briefly illustrating another example of a demultiplexing circuit portion shown in FIG. 1.

Referring to FIG. 12, the demultiplexing circuit portion 140 may include a voltage controller 141, a switching portion 143 and a voltage discharge portion 145.

The voltage controller 141 may control a voltage VA of a control line CL in response to time-division control signals ASW1 and BSW1. The voltage controller 141 may more increase the voltage VA of the control line CL based on auxiliary signals ASW2 and BSW2 partially overlapped with the time-division control signals ASW1 and BSW1. For example, the voltage controller 141 may drive the voltage of the control line CL at a voltage higher than those of the time-division control signals ASW1 and BSW1 by bootstrapping the voltage VA of the control line CL based on the auxiliary signals ASW2 and BSW2, whereby the output of the demultiplexing circuit portion 140 may stably be maintained.

The voltage controller 141 may include a first transistor M1 and a capacitor Cbst.

The first transistor M1 may be turned on based on the first time-division control signal ASW1 to supply the first time-division control signal ASW1 to the control line CL. In detail, a drain electrode and a gate electrode of the first transistor M1 may receive the first time-division control signal ASW1, and a source electrode of the first transistor M1 may be connected with the control line CL. Therefore, if the first time-division control signal ASW1 corresponds to a high potential voltage, the voltage VA of the control line CL may maintain the high potential voltage.

The capacitor Cbst may more increase the voltage VA of the control line CL based on the first auxiliary signal ASW2 partially overlapped with the first time-division control signal ASW1. In detail, one end of the capacitor Cbst may receive the first auxiliary signal ASW2, and the other end of the capacitor Cbst may be connected with the control line CL. In this case, a first transition time period and a second transition time period of the first auxiliary signal ASW2 may correspond to a time period between a first transition time period and a second transition time period of the first time-division control signal ASW1. That is, after the first time-division control signal ASW1 is applied to the drain electrode and the gate electrode of the first transistor M1, the first auxiliary signal ASW2 may be applied to one end of the capacitor Cbst. In this way, after the first transistor M1 is turned on based on the first time-division control signal ASW1 to supply the first time-division control signal ASW1 to the control line CL, the capacitor Cbst performs bootstrapping for the voltage VA of the control line CL based on the first auxiliary signal ASW2, whereby the voltage controller 141 may stably maintain the output of the demultiplexing circuit portion 140. Meanwhile, if supply of the first auxiliary signal ASW2 supplied to one end of the capacitor Cbst is stopped, the voltage VA of the control line CL may return to a voltage prior to bootstrapping.

The switching portion 143 may supply the data signal supplied from the data driving circuit portion 120 to at least two data lines DL based on the voltage VA of the control line CL in due order. The switching portion 143 may include a third transistor M3.

The third transistor M3 may be turned on based on the voltage VA of the control line CL to sequentially supply the data signals received from the output channel CH of the driving integrated circuit 123 to at least two data lines DL. In detail, a gate electrode of the third transistor M3 may be connected with the control line CL, a drain electrode of the third transistor M3 may be connected with the output channel CH of the driving integrated circuit 123, and a source electrode of the third transistor M3 may be connected with the data line DL. Therefore, the third transistor M3 may be turned on while the control line CL has a high potential voltage by means of the first time-division control signal ASW1 and is bootstrapped by the first auxiliary signal ASW2, thereby sequentially supplying the data signals to at least two data lines DL.

According to one example, the third transistor M3 may be turned on from the first transition time period to the second transition time period of the first time-division control signal ASW1, thereby sequentially supplying the data signals to at least two data lines. In detail, since the control line CL is charged by the first transistor M1 if the first time-division control signal ASW1 has a high potential voltage, and is discharged by the second transistor M2 if the first time-division control signal ASW1 has a low potential voltage, the third transistor M3 may be turned on from the first transition time period of the first time-division control signal ASW1 to the second transition time period thereof.

The voltage discharge portion 145 may discharge the voltage VA of the control line CL in response to the time-division control signals ASW1 and BSW1. In detail, the voltage discharge portion 145 may be turned on based on a voltage VN of a discharge node DN controlled by the time-division control signals ASW1 and BSW1 to discharge the control line CL. For example, the voltage discharge portion 145 may discharge the voltage VA of the control line CL based on the voltage VN of the discharge node DN having a voltage inverted with the time-division control signals ASW1 and BSW1. In this case, since the voltage VN of the discharge node DN has a voltage inverted with one time-division control signal ASW1 corresponding to one control line CL, the voltage discharge portion 145 may improve discharging efficiency of the demultiplexing circuit portion 140 by using only one time-division control signal ASW1 corresponding to one control line CL, and an off current transferred to an organic light emitting diode may be prevented from occurring. That is, the demultiplexing circuit portion 140 shown in FIG. 12 may minimize a layout of signal lines by reducing the number of time-division control signals related to one control line CL as compared with the demultiplexing circuit portion 140 shown in FIG. 2, and the number of terminals of the demultiplexing circuit portion 140 may be minimized.

The voltage discharge portion 145 may include a second transistor M2, a fourth transistor M4, and a fifth transistor M5.

The second transistor M2 may be turned on based on the voltage VN of the discharge node DN controlled by the first time-division control signal ASW1 to discharge the voltage VA of the control line CL. In detail, a gate electrode of the second transistor M2 may be connected with the discharge node DN, a drain electrode of the second transistor M2 may be connected with the control line CL and a source electrode of the second transistor M2 may receive the first time-division control signal ASW1. Also, the gate electrode of the second transistor M2 may be connected with each of a source electrode of the fourth transistor M4 and a drain electrode of the fifth transistor M5. At this time, the discharge node DN may have a voltage inverted with the time-division control signal ASW1. Therefore, if the first time-division control signal ASW1 of the low potential voltage is applied to the source electrode of the second transistor M2, the second transistor M2 may be turned on by the discharge node DN having the high potential voltage, and the voltage of the control line CL may be discharged.

The fourth transistor M4 may be turned on based on power voltage VDD to supply the power voltage VDD to the discharge node DN. In detail, a drain electrode and a gate electrode of the fourth transistor M4 may receive the power voltage VDD, and the source electrode of the fourth transistor M4 may be connected with the discharge node DN.

The fifth transistor M5 may be turned on based on the first time-division control signal ASW1 to discharge the discharge node DN. In detail, a gate electrode of the fifth transistor M5 may receive the first time-division control signal ASW1, the drain electrode of the fifth transistor M5 may be connected with the discharge node DN, and a source electrode of the fifth transistor M5 may be connected with a ground voltage VSS. Therefore, the discharge node DN may have a low potential voltage by means of the ground voltage VSS if the fifth transistor M5 is turned on, and may have a high potential voltage by means of the power voltage VDD if the fifth transistor M5 is turned off. That is, the voltage VN of the discharge node DN may be determined by depending on the first time-division control signal ASW1 for determining turn-on and turn-off of the fifth transistor M5.

As described above, since the voltage VN of the discharge node DN has a voltage inverted with the first time-division control signal ASW1 corresponding to the control line CL, the voltage discharge portion 145 may improve discharging efficiency of the demultiplexing circuit portion 140 by using only the first time-division control signal ASW1 corresponding to one control line CL, and may prevent an off current transferred to an organic light emitting diode from occurring.

Figure 13:
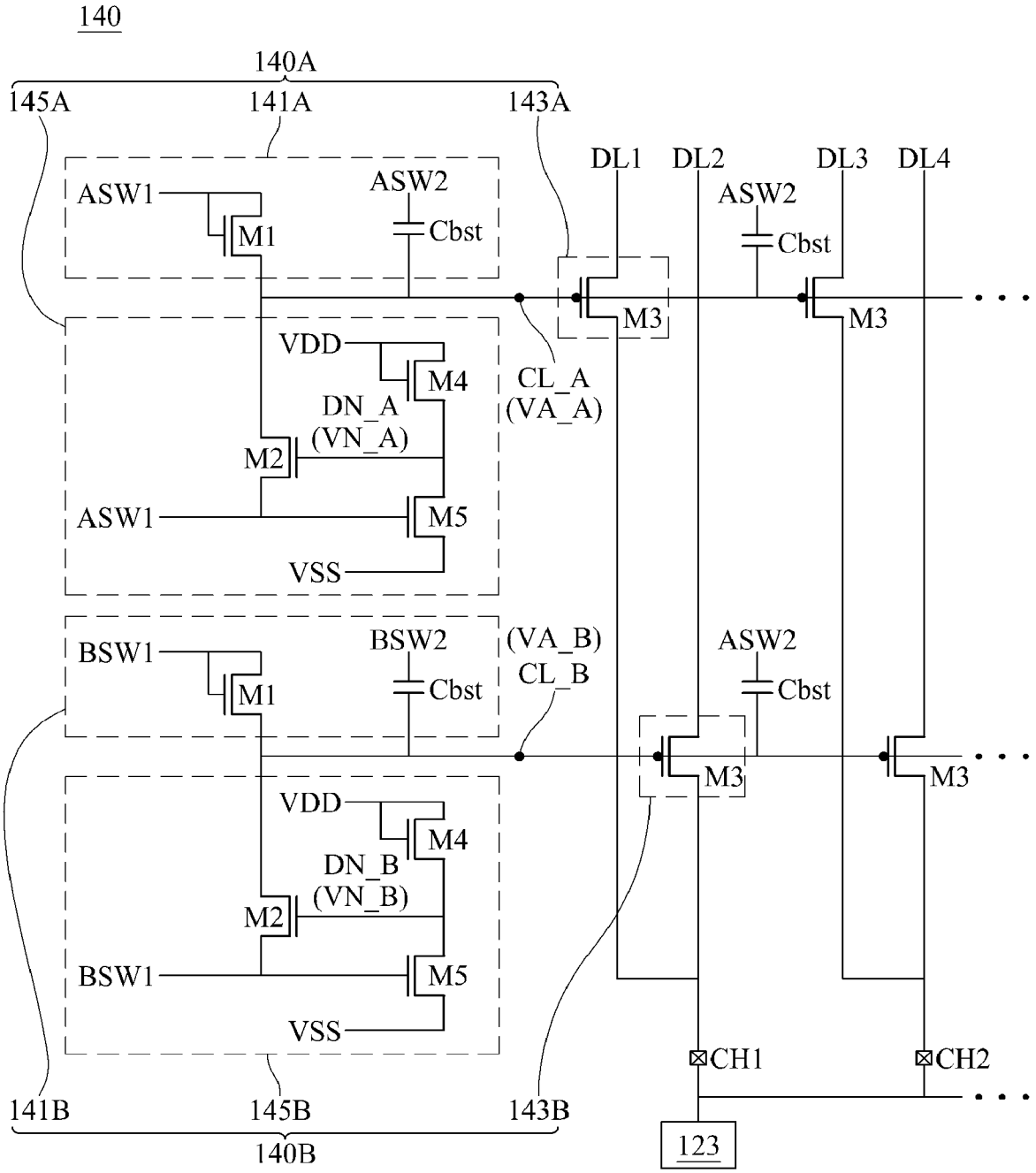
FIG. 13 is a circuit view illustrating that a demultiplexing circuit shown in FIG. 12 drives two data lines from one output channel.
Figure 14:
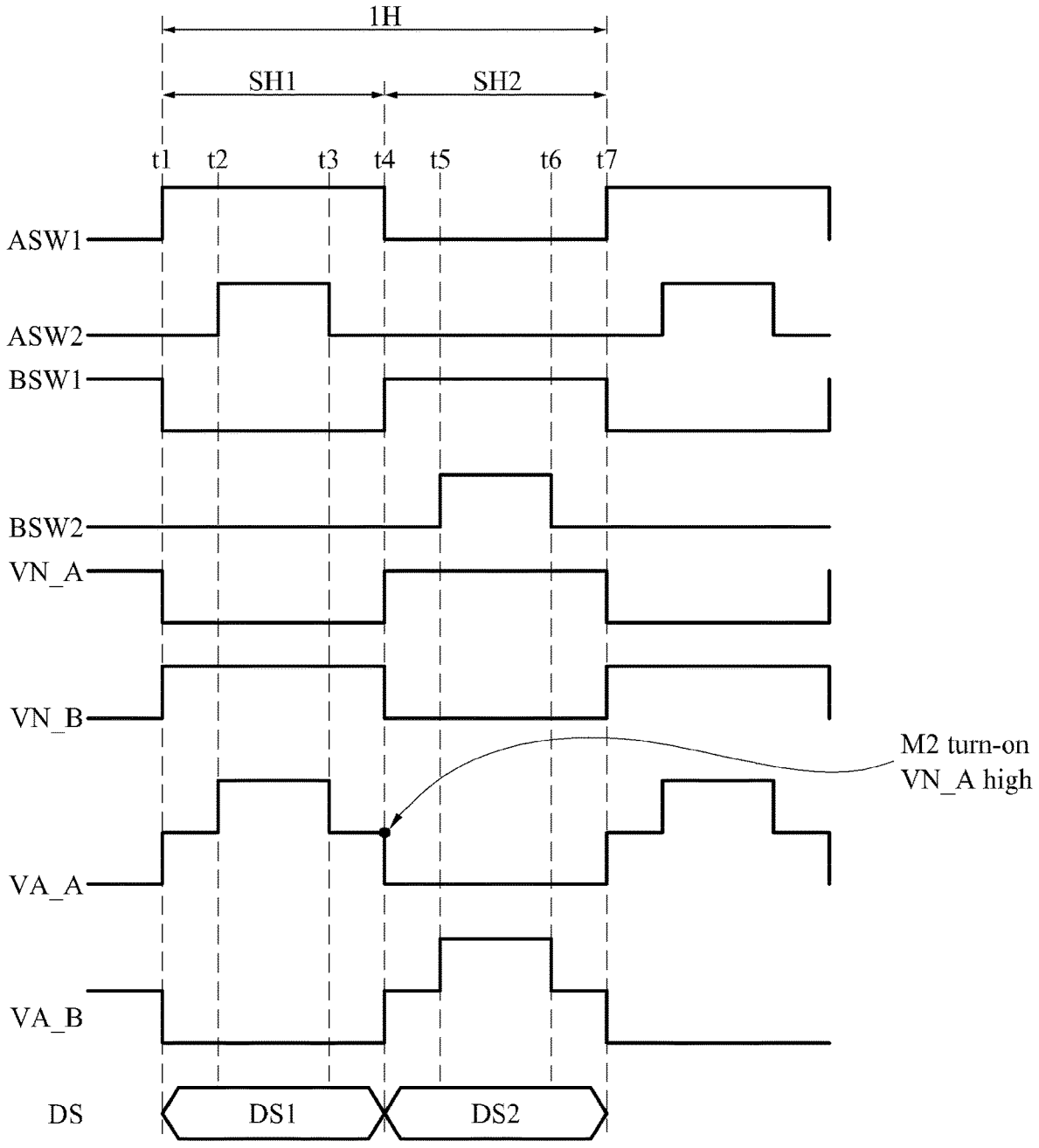
FIG. 14 is a waveform of signals supplied to a demultiplexing circuit portion shown in FIG. 13.

FIG. 13 is a circuit view illustrating that the demultiplexing circuit portion shown in FIG. 12 drives two data lines from one output channel, and FIG. 14 is a waveform of signals supplied to the demultiplexing circuit portion shown in FIG. 13.

Referring to FIGS. 13 and 14, if the demultiplexing circuit portion 140 is connected with two control lines CL_A and CL_B and connected with n data lines DL, the plurality of driving integrated circuits 123 of the data driving circuit portion 120 may have n/2 output channels CH. Therefore, as the display apparatus comprises the demultiplexing circuit portion 140 connected with two control lines CL_A and CL_B, image of high resolution may be embodied while the number of output channels CH of the plurality of driving integrated circuits 123 may be reduced to ½ as compared with the display apparatus that does not comprise the demultiplexing circuit portion 140.

The demultiplexing circuit portion 140 may include a first voltage controller 141A, a first switching portion 143A and a first voltage discharge portion 145A, which are connected with the first control line CL_A, and a second voltage controller 141B, a second switching portion 143B and a second voltage discharge portion 145B, which are connected with the second control line CL_B.

The first transistor M1 of the first voltage controller 141A may be turned on based on the first time-division control signal ASW1 to supply the first time-division control signal ASW1 to the first control line CL_A, and the capacitor Cbst of the first voltage controller 141A may bootstrap a voltage VA_A of the first control line CL_A based on the first auxiliary signal ASW2 overlapped with the first time-division control signal ASW1.

The first transistor M1 of the second voltage controller 141B may be turned on based on the second time-division control signal BSW1 to supply the second time-division control signal BSW1 to the second control line CL_B, and the capacitor Cbst of the second voltage controller 141B may bootstrap a voltage VA_B of the second control line CL_B based on the second auxiliary signal BSW2 overlapped with the second time-division control signal BSW1.

In this way, the first voltage controller 141A may maintain the voltage VA_A of the first control line CL_A at a high potential voltage for a first sub horizontal period SH1 of one horizontal period 1H, and the second voltage controller 141B may maintain the voltage VA_B of the second control line CL_B at a high potential voltage for a second sub horizontal period SH2 of one horizontal period 1H.

According to one example, a first transition time period t2 and a second transition time period t3 of the first auxiliary signal ASW2 may correspond to a time period between a first transition time period t1 and a second transition time period t4 of the first time-division control signal ASW1, and a first transition time period t5 and a second transition time period t6 of the second auxiliary signal BSW2 may correspond to a time period between a first transition time period t4 and a second transition time period t7 of the second time-division control signal BSW1. In this case, a first transition time period of each of a plurality of signals may correspond to, but is not limited to, a rising edge, and a second transition time period thereof may correspond to, but is not limited to, a falling edge. Therefore, the voltage VA_A of the first control line CL_A may primarily be increased at the time period t1 when the first time-division control signal ASW1 is applied, and may secondarily be increased by bootstrapping at a time period t2 when the first auxiliary signal ASW2 is applied. Also, the voltage VA_B of the second control line CL_B may primarily be increased at the time period t4 when the second time-division control signal BSW1 is applied, and may secondarily be increased by bootstrapping at a time period t5 when the second auxiliary signal BSW2 is applied. Meanwhile, the voltages VA_A and VA_B of each of the first and second control lines CL_A and CL_B may return to the voltages prior to bootstrapping at the second transition time periods t3 and t6 of each of the first and second auxiliary signals ASW2 and BSW2.

The third transistor M3 of the first switching portion 143A may be turned on based on the voltage VA_A of the first control line CL_A to supply a data signal DS1 supplied from the plurality of output channels CH of the driving integrated circuit 123 to first data lines DL1, DL3, . . . , DLn−1 of two data lines corresponding to each of the plurality of output channels CH.

According to one example, the third transistor M3 of the first switching portion 143A may be turned on from the first transition time period t1 of the first time-division control signal ASW1 to the second transition time period t4 of the first time-division control signal ASW1 to supply the data signal DS1 to the first data lines DL1, DL3, . . . , DLn−1 of two data lines DL. In detail, since the control line CL is charged by the first transistor M1 from the time period t1 when the first time-division control signal ASW1 has a high potential voltage and discharged by the second transistor M2 from the time period t4 when the first time-division control signal ASW1 has a low potential voltage, the third transistor M3 may be turned on from the first transition time period t1 of the first time-division control signal ASW1 to the second transition time period t4 of the first time-division control signal ASW1.

The third transistor M3 of the second switching portion 143B may be turned on based on the voltage VA_B of the second control line CL_B to supply a data signal DS2 supplied from the plurality of output channels CH of the driving integrated circuit 123 to second data lines DL2, DL4, . . . , DLn of two data lines corresponding to each of the plurality of output channels CH.

In this way, the first switching portion 143A may be turned on for the first sub horizontal period SH1 of one horizontal period 1H to supply the data signal DS1 to the first data lines DL1, DL3, . . . , DLn−1 of two data lines DL corresponding to each of the plurality of output channels CH, and the second switching portion 143B may be turned on for the second sub horizontal period SH2 of one horizontal period 1H to supply the data signal DS2 to the second data lines DL2, DL4, . . . , DLn of two data lines DL corresponding to each of the plurality of output channels CH. Therefore, as the display apparatus comprises the demultiplexing circuit portion 140 connected with two control lines CL_A and CL_B, image of high resolution may be embodied while the number of output channels CH of the plurality of driving integrated circuits 123 may be reduced to ½ as compared with the display apparatus that does not comprise the demultiplexing circuit portion 140.

The second transistor M2 of the first voltage discharge portion 145A may be turned on based on the voltage VN_A of the discharge node DN_A, which is inverted with the first time-division control signal ASW1, to discharge the voltage VA_A of the first control line CL_A, the fourth transistor M4 of the first voltage discharge portion 145A may be turned on based on the power voltage VDD to supply the power voltage VDD to the discharge node DN_A, and the fifth transistor M5 of the first voltage discharge portion 145A may be turned on based on the first time-division control signal ASW1 to discharge the discharge node DN_A.

The second transistor M2 of the second voltage discharge portion 145B may be turned on based on a voltage VN_B of a discharge node DN_B, which is inverted with the second time-division control signal BSW1, to discharge the voltage VA_B of the second control line CL_B, the fourth transistor M4 of the second voltage discharge portion 145B may be turned on based on the power voltage VDD to supply the power voltage VDD to the discharge node DN_B, and the fifth transistor M5 of the second voltage discharge portion 145B may be turned on based on the second time-division control signal BSW1 to discharge the discharge node DN_B.

As described above, the second transistor M2 of the first voltage discharge portion 145A may be turned on at a time period t4 when the first sub horizontal period SH1 of one horizontal period 1H ends or the second sub horizontal period SH2 starts, to discharge the voltage VA_A of the first control line CL_A. At this time, the voltage VN of the discharge node DN for turning on the second transistor M2 of the voltage discharge portion 145 may stably be maintained by the fourth and fifth transistors M4 and M5. Therefore, as the voltage discharge portion 145 of the demultiplexing circuit portion 140 includes the fourth and fifth transistors M4 and M5, the voltage discharge portion 145 may improve discharging efficiency of the voltage VA of the control line CL even in the case that the second transistor M2 is degraded, and may prevent an off current transferred to an organic light emitting diode from occurring. As a result, the demultiplexing circuit portion 140 may stably maintain the output of the third transistor M3 turned on based on the voltage VA of the control line CL, whereby luminance of the display panel may be prevented from being deteriorated and image of high resolution of the display panel may be embodied.

According to one example, each of the first transistor M1 of the voltage controller 141 and the second transistor M2, the fourth transistor M4 and the fifth transistor M5 of the voltage discharge portion 145 may be arranged at each of both ends of one control line CL, and one control line CL may be connected with a plurality of capacitors Cbst and a plurality of switching portions 143. In this way, the first transistor M1 and the second transistor M2 arranged at each of both ends of the control line CL may turn on or turn off the plurality of switching portions 143 connected with the control line CL by charging or discharging the voltage VA of the control line CL. At this time, as the voltage discharge portion 145 includes the fourth and fifth transistors M4 and M5 for stably maintaining the voltage VN of the discharge node DN, discharging efficiency of the voltage VA of the control line CL may be improved.

Figure 15:
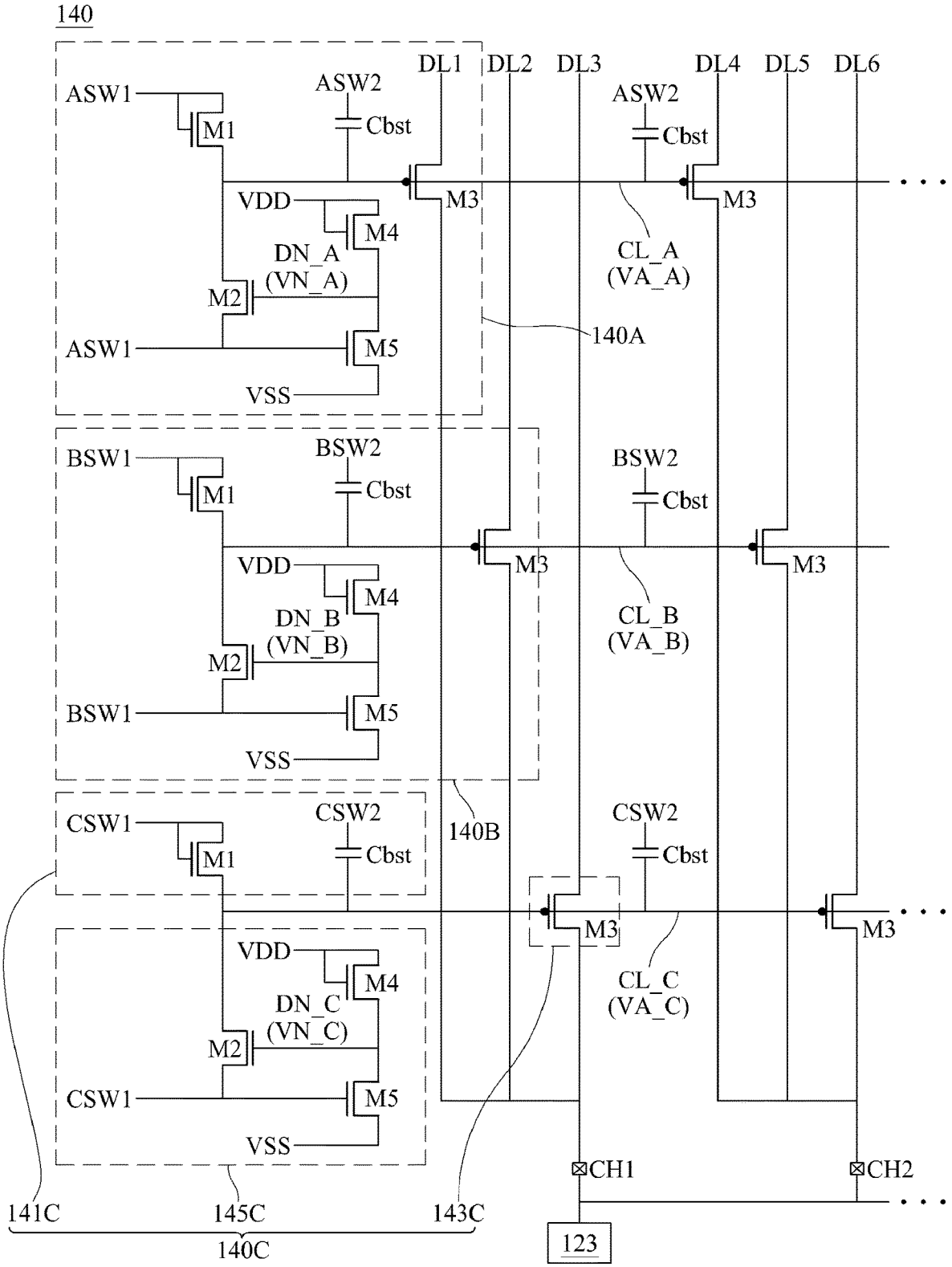
FIG. 15 is a circuit view illustrating that a demultiplexing circuit shown in FIG. 12 drives three data lines from one output channel.
Figure 16:
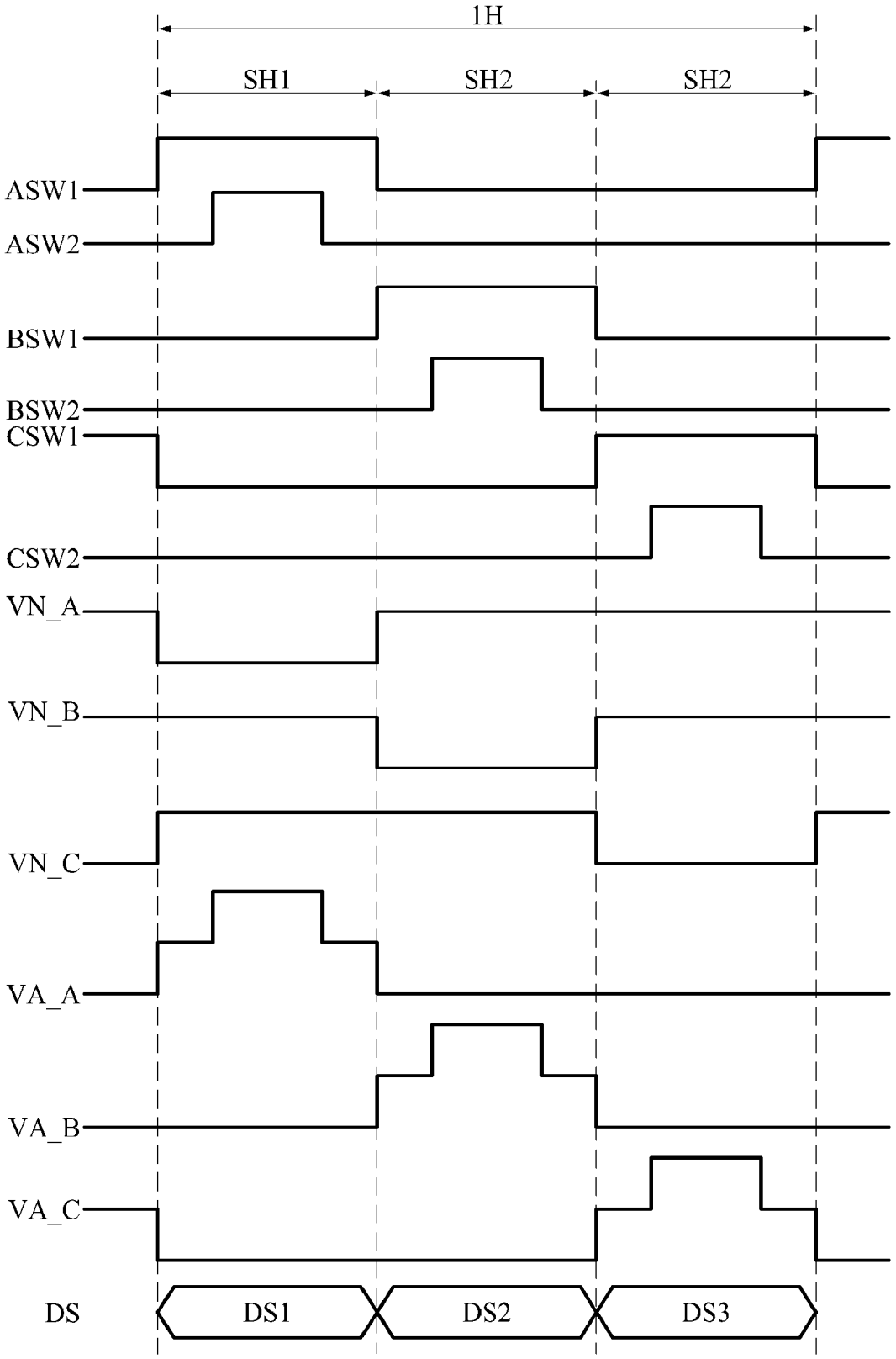
FIG. 16 is a waveform of signals supplied to a demultiplexing circuit portion shown in FIG. 15.

FIG. 15 is a circuit view illustrating that the demultiplexing circuit portion shown in FIG. 12 drives three data lines from one output channel, and FIG. 16 is a waveform of signals supplied to a demultiplexing circuit portion shown in FIG. 15.

Referring to FIGS. 15 and 16, if the demultiplexing circuit portion 140 is connected with three control lines CL_A, CL_B and CL_C and connected with n data lines DL, the plurality of driving integrated circuits 123 of the data driving circuit portion 120 may have n/3 output channels CH. Therefore, as the display apparatus comprises the demultiplexing circuit portion 140 connected with three control lines CL_A, CL_B and CL_C, image of high resolution may be embodied while the number of output channels CH of the plurality of driving integrated circuits 123 may be reduced to ⅓ as compared with the display apparatus that does not comprise the demultiplexing circuit portion 140.

The demultiplexing circuit portion 140 may include a first voltage controller 141A, a first switching portion 143A and a first voltage discharge portion 145A, which are connected with the first control line CL_A, a second voltage controller 141B, a second switching portion 143B and a second voltage discharge portion 145B, which are connected with the second control line CL_B, and a third voltage controller 141C, a third switching portion 143C and a third voltage discharge portion 145C, which are connected with the third control line CL_C.

The first transistor M1 of the first voltage controller 141A may be turned on based on the first time-division control signal ASW1 to supply the first time-division control signal ASW1 to the first control line CL_A, and the capacitor Cbst of the first voltage controller 141A may bootstrap a voltage VA_A of the first control line CL_A based on the first auxiliary signal ASW2 overlapped with the first time-division control signal ASW1.

The first transistor M1 of the second voltage controller 141B may be turned on based on the second time-division control signal BSW1 to supply the second time-division control signal BSW1 to the second control line CL_B, and the capacitor Cbst of the second voltage controller 141B may bootstrap a voltage VA_B of the second control line CL_B based on the second auxiliary signal BSW2 overlapped with the second time-division control signal BSW1.

The first transistor M1 of the third voltage controller 141C may be turned on based on the third time-division control signal CSW1 to supply the third time-division control signal CSW1 to the third control line CL_C, and the capacitor Cbst of the third voltage controller 141C may bootstrap a voltage VA_C of the third control line CL_C based on the third auxiliary signal CSW2 overlapped with the third time-division control signal CSW1.

In this way, the first voltage controller 141A may maintain the voltage VA_A of the first control line CL_A at a high potential voltage for the first sub horizontal period SH1 of one horizontal period 1H, the second voltage controller 141B may maintain the voltage VA_B of the second control line CL_B at a high potential voltage for the second sub horizontal period SH2 of one horizontal period 1H, and the third voltage controller 141C may maintain the voltage VA_C of the third control line CL_C at a high potential voltage for a third sub horizontal period SH3 of one horizontal period 1H.

The third transistor M3 of the first switching portion 143A may be turned on based on the voltage VA_A of the first control line CL_A to supply a data signal DS1 supplied from the plurality of output channels CH of the driving integrated circuit 123 to first data lines DL1, DL4, . . . , DLn−2 of three data lines corresponding to each of the plurality of output channels CH.

The third transistor M3 of the second switching portion 143B may be turned on based on the voltage VA_B of the second control line CL_B to supply a data signal DS2 supplied from the plurality of output channels CH of the driving integrated circuit 123 to second data lines DL2, DL5, . . . , DLn−1 of three data lines corresponding to each of the plurality of output channels CH.

The third transistor M3 of the third switching portion 143C may be turned on based on the voltage VA_C of the third control line CL_C to supply a data signal DS3 supplied from the plurality of output channels CH of the driving integrated circuit 123 to third data lines DL3, DL6, . . . , DLn of three data lines corresponding to each of the plurality of output channels CH.

In this way, the first switching portion 143A may be turned on for the first sub horizontal period SH1 of one horizontal period 1H to supply the data signal DS1 to the first data lines DL1, DL4, . . . , DLn−2 of three data lines DL corresponding to each of the plurality of output channels CH, the second switching portion 143B may be turned on for the second sub horizontal period SH2 of one horizontal period 1H to supply the data signal DS2 to the second data lines DL2, DL5, . . . , DLn−1 of three data lines DL corresponding to each of the plurality of output channels CH, and the third switching portion 143C may be turned on for the third sub horizontal period SH3 of one horizontal period 1H to supply the data signal DS3 to the third data lines DL3, DL6, . . . , DLn of three data lines DL corresponding to each of the plurality of output channels CH. Therefore, as the display apparatus comprises the demultiplexing circuit portion 140 connected with three control lines CL_A, CL_B and CL_C, image of high resolution may be embodied while the number of output channels CH of the plurality of driving integrated circuits 123 may be reduced to ⅓ as compared with the display apparatus that does not comprise the demultiplexing circuit portion 140.

The second transistor M2 of the first voltage discharge portion 145A may be turned on based on a voltage VN_A of a discharge node DN_A, which is inverted with the first time-division control signal ASW1, to discharge the voltage VA_A of the first control line CL_A, the fourth transistor M4 of the first voltage discharge portion 145A may be turned on based on the power voltage VDD to supply the power voltage VDD to the discharge node DN_A, and the fifth transistor M5 of the first voltage discharge portion 145A may be turned on based on the first time-division control signal ASW1 to discharge the discharge node DN_A.

The second transistor M2 of the second voltage discharge portion 145B may be turned on based on a voltage VN_B of a discharge node DN_B, which is inverted with the second time-division control signal BSW1, to discharge the voltage VA_B of the second control line CL_B, the fourth transistor M4 of the second voltage discharge portion 145B may be turned on based on the power voltage VDD to supply the power voltage VDD to the discharge node DN_B, and the fifth transistor M5 of the second voltage discharge portion 145B may be turned on based on the second time-division control signal BSW1 to discharge the discharge node DN_B.

The second transistor M2 of the third voltage discharge portion 145C may be turned on based on a voltage VN_C of a discharge node DN_C, which is inverted with the third time-division control signal CSW1, to discharge the voltage VA_C of the third control line CL_C, the fourth transistor M4 of the third voltage discharge portion 145C may be turned on based on the power voltage VDD to supply the power voltage VDD to the discharge node DN_C, and the fifth transistor M5 of the third voltage discharge portion 145C may be turned on based on the third time-division control signal CSW1 to discharge the discharge node DN_C.

Therefore, as the voltage discharge portion 145 of the demultiplexing circuit portion 140 includes the fourth and fifth transistors M4 and M5, the voltage discharge portion 145 may improve discharging efficiency of the voltage VA of the control line CL even in the case that the second transistor M2 is degraded, and may prevent an off current transferred to an organic light emitting diode from occurring. As a result, the demultiplexing circuit portion 140 may stably maintain the output of the third transistor M3 turned on based on the voltage VA of the control line CL, whereby luminance of the display panel may be prevented from being deteriorated and image of high resolution of the display panel may be embodied.

Figure 17:
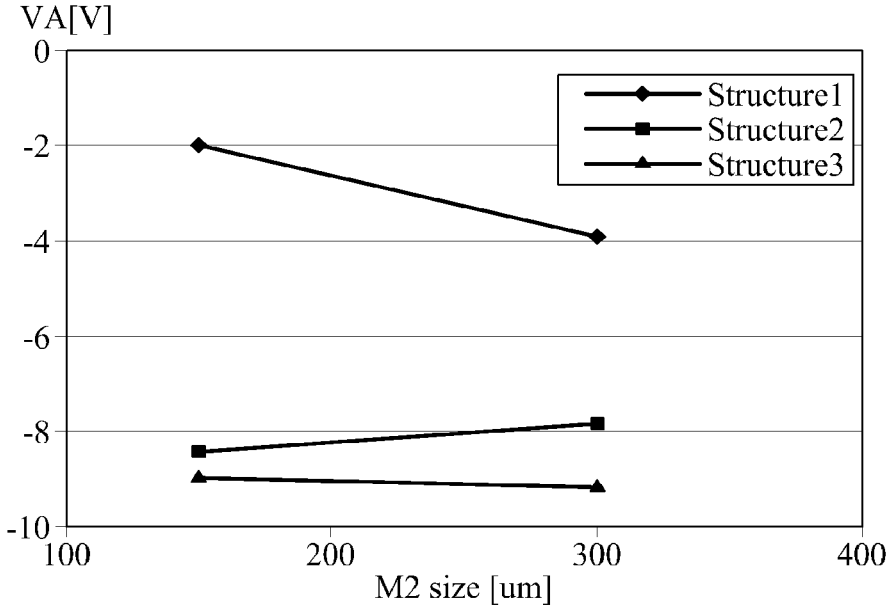
FIG. 17 is a graph illustrating a discharging effect of a demultiplexing circuit portion shown in FIG. 12.

FIG. 17 is a graph illustrating a discharging effect of the demultiplexing circuit portion shown in FIG. 12. In detail, FIG. 17 is a graph illustrating a voltage VA of a discharged control line CL with respect to a size of the second transistor M2. A gate low voltage VGL of the discharged control line CL corresponds to −10V. In this case, Structure 1 corresponds to the demultiplexing circuit portion 140 which does not include any one of a discharge transistor M21 and fourth and fifth transistors M4 and M5, Structure 2 corresponds to a demultiplexing circuit portion 140 that includes a discharge transistor M21 shown in FIG. 2, and Structure 3 corresponds to a demultiplexing circuit portion 140 that includes fourth and fifth transistors M4 and M5 shown in FIG. 12.

Referring to FIG. 17, if a size of the second transistor M2 of the Structure 1 is 150 μm, the voltage VA of the discharged control line CL corresponds to −2V, approximately, if a size of the second transistor M2 of the Structure 2 is 150 μm, the voltage VA of the discharged control line CL corresponds to −8.5V, approximately, and if a size of the second transistor M2 of the Structure 3 is 150 μm, the voltage VA of the discharged control line CL corresponds to −9V, approximately. That is, as the Structure 2 includes the discharge transistor M21, it is noted that discharging efficiency of the control line CL is more improved than that of the Structure 1, and as the Structure 3 includes fourth and fifth transistors M4 and M5, it is noted that discharging efficiency of the control line CL is more improved than that of each of the Structure 1 and the Structure 2.

Also, if a size of the second transistor M2 of the Structure 1 is 300 μm, the voltage VA of the discharged control line CL corresponds to −4V, approximately, if a size of the second transistor M2 of the Structure 2 is 300 μm, the voltage VA of the discharged control line CL corresponds to −7.8V, approximately, and if a size of the second transistor M2 of the Structure 3 is 300 μm, the voltage VA of the discharged control line CL corresponds to −9V, approximately. That is, as the Structure 2 includes the discharge transistor M21, it is noted that discharging efficiency of the control line CL is more improved than that of the Structure 1, and as the Structure 3 includes fourth and fifth transistors M4 and M5, it is noted that discharging efficiency of the control line CL is more improved than that of each of the Structure 1 and the Structure 2.

As described above, after the demultiplexing circuit portion 140 (Structure 2) primarily discharges the voltage VA of the control line CL based on the second time-division control signal BSW1, the discharge transistor M21 secondarily discharges the voltage VA of the control line CL based on the second auxiliary signal BSW2, whereby the voltage discharge portion 145 may improve discharging efficiency of the demultiplexing circuit portion 140 and therefore prevent an off current transferred to an organic light emitting diode from occurring.

Also, the second transistor M2 of the demultiplexing circuit portion 140 (Structure 3) according to another example of the present disclosure may discharge the voltage VA of the control line CL based on the voltage VN of the discharge node DN controlled by the first time-division control signal ASW1. In this case, since the voltage VN of the discharge node DN has a voltage inverted with one time-division control signal ASW1 corresponding to one control line CL, the voltage discharge portion 145 may improve discharging efficiency of the demultiplexing circuit portion 140 by using only one time-division control signal ASW1 corresponding to one control line CL, and an off current transferred to an organic light emitting diode may be prevented from occurring. That is, the demultiplexing circuit portion 140 according to the Structure 3 may minimize a layout of signal lines by reducing the number of time-division control signals related to one control line CL as compared with the demultiplexing circuit portion 140 according to the Structure 1 and the Structure 2, and the number of terminals of the demultiplexing circuit portion 140 may be minimized.

Figure 18:
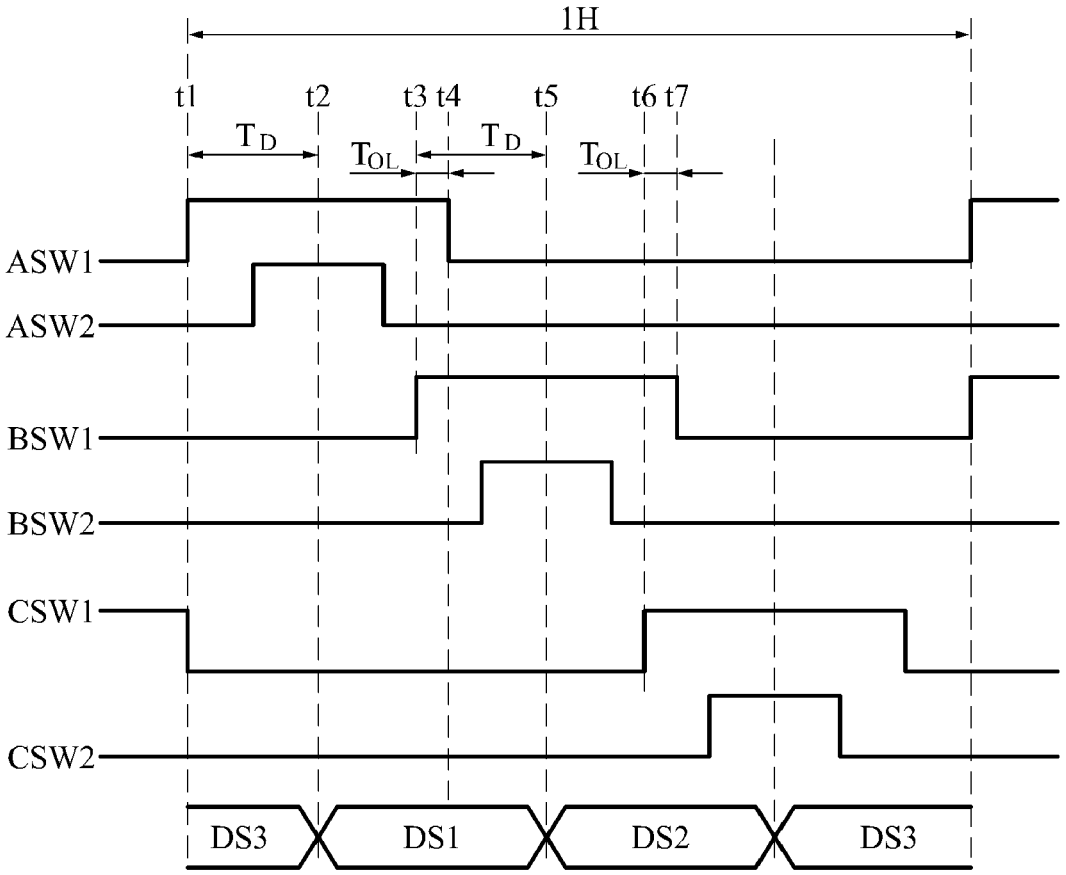
FIG. 18 is a waveform illustrating one example of a driving method of a demultiplexing circuit portion shown in FIG. 12.

FIG. 18 is a waveform illustrating one example of a driving method of the demultiplexing circuit portion shown in FIG. 12.

Referring to FIG. 18, if the demultiplexing circuit portion 140 is connected with three control lines CL_A, CL_B and CL_C and connected with n data lines DL, the plurality of driving integrated circuits 123 of the data driving circuit portion 120 may have n/3 output channels CH. At this time, the time-division control signals may include first to third time-division control signals ASW1, BSW1 and CSW1 which are sequentially supplied for one horizontal period 1H, and each of the first to third time-division control signals ASW1, BSW1 and CSW1 may correspond to each of the first to third control lines CL_A, CL_B and CL_C.

At this time, since the demultiplexing circuit portion 140 according to the present disclosure provides data signals DS to each of three data lines DL for one horizontal period 1H while using an oxide based thin film transistor, a pixel charging time of each of the three control lines CL may be reduced as compared with the case that the demultiplexing circuit portion 140 is not provided. In this case, the pixel charging time may correspond to a turn-on time of the switching portion 143 for each of the three control lines CL as each of the three control lines CL has a high potential voltage. Therefore, as the demultiplexing circuit portion 140 is connected with i control lines CL (i is a natural number of 2 or more), a pixel charging time for each of the i control lines CL may be reduced as much as 1/i as compared with the case that the demultiplexing circuit portion 140 is not provided.

According to one example, the first and second time-division control signals ASW1 and BSW1 may partially be overlapped with each other, and the second and third time-division control signals BSW1 and CSW1 may partially overlap each other.

If the first to third time-division control signals ASW1, BSW1 and CSW1 are spaced apart from one another without being overlapped with one another, pixel is not charged from a second transition time period of one of the first to third time-division control signals ASW1, BSW1 and CSW1 to a first transition time period of next time-division control signal which is applied. Therefore, the pixel charging time of the demultiplexing circuit portion 140 is reduced as much as the time when each of the first to third time-division control signals is spaced apart from another one.

Therefore, the demultiplexing circuit portion 140 according to the present disclosure may sufficiently increase a pixel charging time without waste of time for one horizontal period 1H by partially overlapping the first to third time-division control signals ASW1, BSW1 and CSW1 with one another. For example, a first transition time period t3 of the second time-division control signal BSW1 is prior to a second transition time period t4 of the first time-division control signal ASW1, whereby the first and second time-division control signals ASW1 and BSW1 may partially be overlapped with each other, and the pixel charging time of the second time-division control signal BSW1 may be increased as much as the overlapping time TOL. Likewise, a first transition time period t6 of the third time-division control signal CSW1 is prior to a second transition time period t7 of the second time-division control signal BSW1, whereby the second and third time-division control signals BSW1 and CSW1 may partially be overlapped with each other, and the pixel charging time of the third time-division control signal CSW1 may be increased as much as the overlapping time TOL. In this way, if the first to third time-division control signals ASW1, BSW1 and CSW1 are partially overlapped with each other, a total of the pixel charging time of each of the first to third time-division control signals ASW1, BSW1 and CSW1 may be longer than one horizontal period 1H. Therefore, as the pixel charging time of each of the three control lines CL is maximized, the demultiplexing circuit portion 140 according to the present disclosure may embody image of high resolution while reducing the number of output channels CH of the plurality of driving integrated circuits 123 to ⅓ as compared with the case that the demultiplexing circuit portion 140 is not provided.

The plurality of driving integrated circuits 123 may provide first to third data signals DS1, DS2 and DS3 respectively corresponding to the first to third time-division control signals ASW1, BSW1 and CSW1 to the demultiplexing circuit portion 140 through one output channel CH. According to one example, the first transition time period of each of the first to third data signals DS1, DS2 and DS3 may be more delayed than the first transition time period of each of the first to third time-division control signals ASW1, BSW1 and CSW1.

If an applying time of each of the first to third data signals DS1, DS2 and DS3 is equal to an applying time of each of the first to third time-division control signals ASW1, BSW1 and CSW1, a problem of color mixture may occur as the first to third data signals DS1, DS2 and DS3 are respectively overlapped with one another due to gate delay of the switching portion 143. Also, to solve the problem of the color mixture, if each of the first to third data signals DS1, DS2 and DS3 is delayed for a blank time, a problem occurs in that the pixel charging time is reduced as much as the blank time.

Therefore, the demultiplexing circuit portion 140 according to the present disclosure may more delay an applying time of each of the first to third data signals DS1, DS2 and DS3 than an applying time of each of the first to third time-division control signals ASW1, BSW1 and CSW1 for a predetermined time TD. For example, an applying time period t2 of the first data signal DS1 may be more delayed than an applying time period t1 of the first time-division control signal ASW1 for a predetermined time TD, and an applying time period t5 of the second data signal DS2 may be more delayed than an applying time period t3 of the second time-division control signal BSW1 for a predetermined time TD. Therefore, since overlap among the first to third data signals DS1, DS2 and DS3 does not occur, the demultiplexing circuit portion 140 may prevent the problem of color mixture from occurring, and the switching portion 143 may be pre-charged for the delayed time TD, whereby a pixel charging rate may remarkably be increased. As a result, the demultiplexing circuit portion 140 may prevent color mixture from occurring by preventing the overlap among the first to third data signals DS1, DS2 and DS3 from occurring, and may embody image of high resolution while reducing the number of output channels CH of the plurality of driving integrated circuits 123 to ⅓ as compared with the case that the demultiplexing circuit portion 140 is not provided by maximizing the pixel charging time for each of the three control lines CL.

Figure 19:
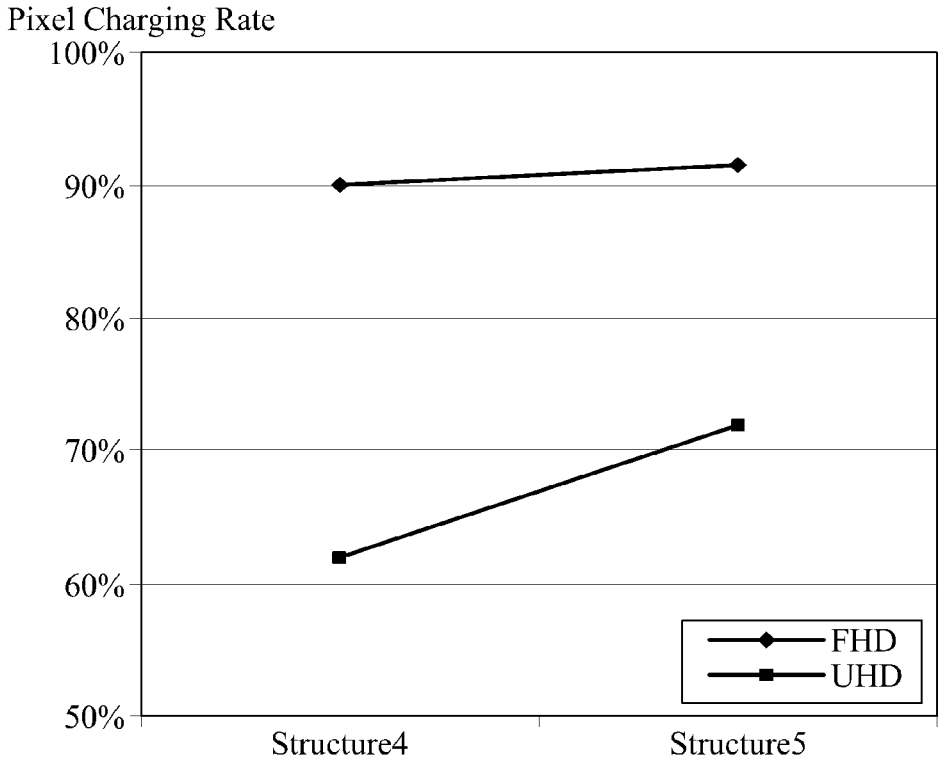
FIG. 19 is a graph illustrating a pixel charging rate improvement effect according to a driving method shown in FIG. 18.

FIG. 19 is a graph illustrating a pixel charging rate improvement effect according to a driving method shown in FIG. 18. In detail, FIG. 19 is a graph illustrating a pixel charging rate of the demultiplexing circuit portion 140 having resolution of full high definition (FHD) and a pixel charging rate of the demultiplexing circuit portion 140 having resolution of ultra-high definition (UHD). In this case, Structure 4 corresponds to the demultiplexing circuit portion 140 to which a data signal and a time-division control signal are applied at the same time, and Structure 5 corresponds to the demultiplexing circuit portion 140 to which a data signal is applied to be more delayed than a time-division control signal as shown in FIG. 18.

Referring to FIG. 19, the demultiplexing circuit portion 140 of the Structure 4 having resolution of FHD has a pixel charging rate of about 90%, and the demultiplexing circuit portion 140 of the Structure 5 having resolution of FHD has a pixel charging rate of about 92%. Therefore, the demultiplexing circuit portion 140 having resolution of FHD has a sufficient pixel charging rate even though the data signal is not more delayed than the time-division control signal.

However, the demultiplexing circuit portion 140 of the Structure 4 having resolution of UHD has a pixel charging rate of about 62%, and the demultiplexing circuit portion 140 of the Structure 5 having resolution of UHD has a pixel charging rate of about 72%. In detail, the demultiplexing circuit portion 140 having resolution of UHD has one horizontal period 1H shorter than that of the demultiplexing circuit portion 140 having resolution of FHD, and the time for driving the demultiplexing circuit portion 140 becomes shorter correspondingly, whereby the pixel charging time is not sufficient. As a result, a problem occurs in that a pixel charging rate is reduced.

Therefore, as an applying time of each of the first to third data signals DS1, DS2 and DS3 may be more delayed than an applying time of each of the first to third time-division control signals ASW1, BSW1 and CSW1 for a predetermined time TD, the demultiplexing circuit portion 140 (Structure 5) may embody image of resolution higher than that of the demultiplexing circuit portion 140 of the Structure 4 by maximizing the pixel charging time for each of the plurality of control lines.

Figure 20:
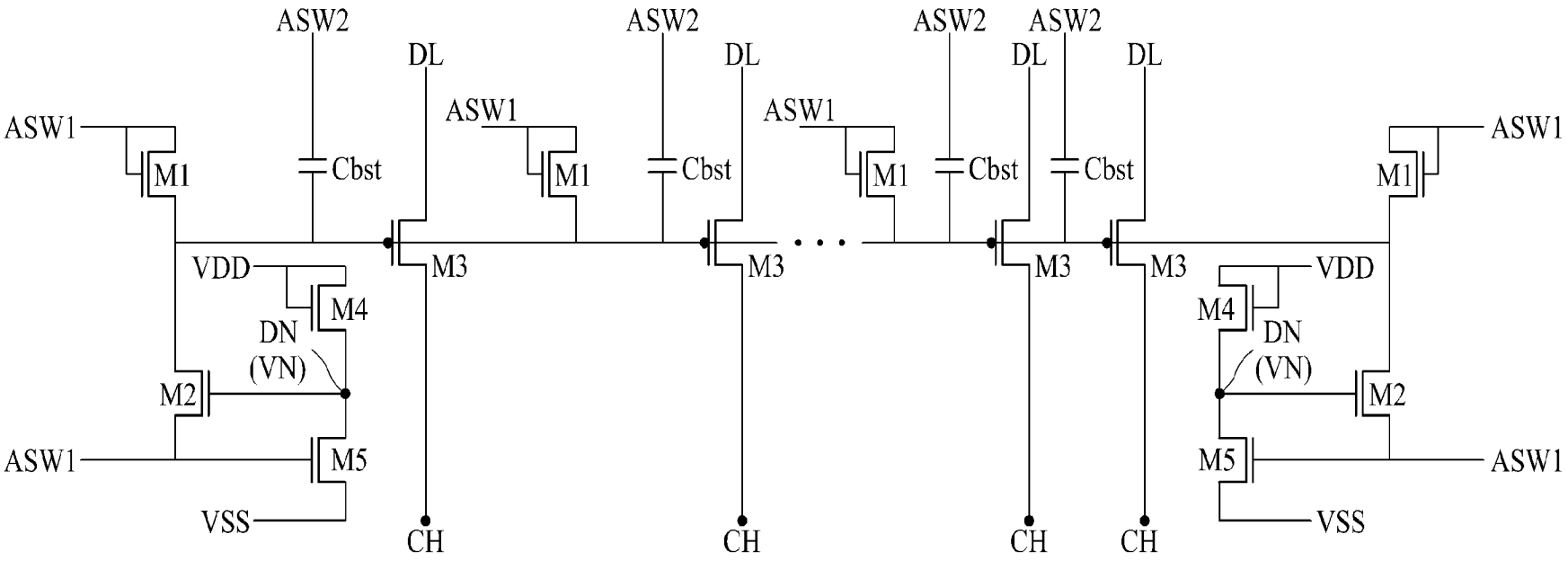
FIG. 20 is a circuit view illustrating another example of a demultiplexing circuit portion shown in FIG. 12.

FIG. 20 is a circuit view illustrating another example of the demultiplexing circuit portion shown in FIG. 12.

Referring to FIG. 20, the demultiplexing circuit portion 140 may include two first transistors M1 and two second, fourth and fifth transistors M2, M4 and M5, which are arranged at each of both ends of one control line CL, wherein one control line CL may be connected with a plurality of capacitors Cbst and a plurality of third transistors M3. At this time, the two first transistors M1 arranged at each of both ends of one control line CL may charge the voltage VA of the control line CL, and the two second, fourth and fifth transistors M2, M4 and M5 arranged at each of both ends of one control line CL may discharge the voltage VA of the control line CL. Each of the plurality of capacitors Cbst may be arranged to correspond to each of the plurality of third transistors M3, whereby the voltage VA of the control line CL may be subjected to bootstrapping.

The voltage controller 141 of the demultiplexing circuit portion 140 may further include p number of first transistors M1 (p is a natural number of 1 to (n/i−2)) turned on based on a kth time-division control signal to supply the kth time-division control signal to a kth control line. In detail, the voltage controller 141 may include additional first transistor M1 separately from the two first transistors M1 arranged at each of both ends of one control line CL, whereby charging efficiency of the control line CL may be improved and therefore the voltage of the control line CL may stably be maintained.

According to one example, the voltage controller 141 of the demultiplexing circuit portion 140 may further include a first transistor M1 by grouping a plurality of capacitors Cbst and a plurality of third transistors M3 in a predetermined unit to correspond to each of the plurality of groups. For example, if the display apparatus includes n data lines DL1 to DLn and the demultiplexing circuit portion 140 is connected with three control lines CL_A, CL_B and CL_C, since one control line CL is connected with n/3 data lines DL, the demultiplexing circuit portion 140 may include n/3 third transistors M3 connected with one control line CL. At this time, the demultiplexing circuit portion 140 may further include n/30 first transistors M1 by grouping a plurality of capacitors Cbst and a plurality of third transistors M3 in a unit of 10 capacitors Cbst and 10 third transistors M3. In this way, the voltage controller 141 of the demultiplexing circuit portion 140 may further include a first transistor M1 corresponding to each of a plurality of groups of a plurality of capacitors Cbst and a plurality of third transistors M3, whereby charging efficiency may be improved in all areas of the control line CL and therefore the voltage of the control line CL may stably be maintained.

According to another example, the voltage controller 141 of the demultiplexing circuit portion 140 may include a first transistor M1 corresponding to each of a plurality of capacitors Cbst and a plurality of third transistors M3. For example, if the display apparatus includes n data lines DL1 to DLn and the demultiplexing circuit portion 140 is connected with three control lines CL_A, CL_B and CL_C, since one control line CL is connected with n/3 data lines DL, the voltage controller 141 of the demultiplexing circuit portion 140 may include n/3 first transistors M1 including a first transistor M1 arranged at each of both ends of the control line CL.

The description of the demultiplexing circuit portion 140 according to one example and another example is only exemplary, and is not limited to the number of the transistors. Therefore, the voltage controller 141 of the demultiplexing circuit portion 140 may improve charging efficiency in all areas of the control line CL and control the number of the first transistors M1 within the range that does not need excessive cost.

Figure 21:
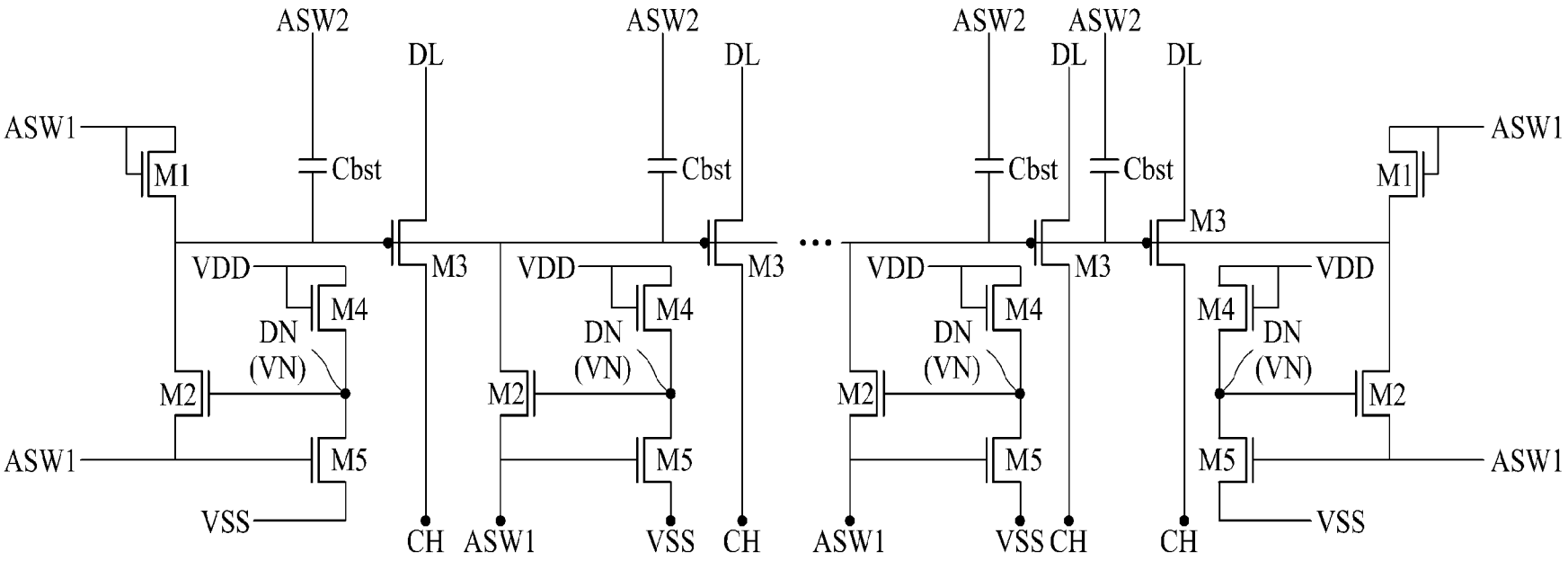
FIG. 21 is a circuit view illustrating still another example of a demultiplexing circuit portion shown in FIG. 12.

FIG. 21 is a circuit view illustrating still another example of the demultiplexing circuit portion shown in FIG. 12.

Referring to FIG. 21, the demultiplexing circuit portion 140 may include two first transistors M1 and two second, fourth and fifth transistors M2, M4 and M5, which are arranged at each of both ends of one control line CL, wherein one control line CL may be connected with a plurality of capacitors Cbst and a plurality of third transistors M3. At this time, the two first transistors M1 arranged at each of both ends of one control line CL may charge the voltage VA of the control line CL, and the two second, fourth and fifth transistors M2, M4 and M5 arranged at each of both ends of one control line CL may discharge the voltage VA of the control line CL. Each of the plurality of capacitors Cbst may be arranged to correspond to each of the plurality of third transistors M3, whereby the voltage VA of the control line CL may be subjected to bootstrapping.

The voltage discharge portion 145 of the demultiplexing circuit portion 140 may further include p number of second transistors M2 (p is a natural number of 1 to (n/i−2)) turned on based on a voltage VN of a discharge node DN controlled by the kth time-division control signal to discharge the kth control line. In detail, the voltage discharge portion 145 may include additional second transistor M2 separately from the two second transistors M2 arranged at each of both ends of one control line CL, whereby discharging efficiency of the control line CL may be improved and therefore an off current transferred to an organic light emitting diode may be prevented from occurring.

According to one example, the voltage discharge portion 145 of the demultiplexing circuit portion 140 may further include a second transistor M2 by grouping a plurality of capacitors Cbst and a plurality of third transistors M3 in a predetermined unit to correspond to each of the plurality of groups. For example, if the display apparatus includes n data lines DL1 to DLn and the demultiplexing circuit portion 140 is connected with three control lines CL_A, CL_B and CL_C, since one control line CL is connected with n/3 data lines DL, the demultiplexing circuit portion 140 may include n/3 third transistors M3 connected with one control line CL. At this time, the demultiplexing circuit portion 140 may further include n/30 second transistors M2 by grouping a plurality of capacitors Cbst and a plurality of third transistors M3 in a unit of 10 capacitors Cbst and 10 third transistors M3. In this way, the voltage discharge portion 145 of the demultiplexing circuit portion 140 may further include a second transistor M2 corresponding to each of a plurality of groups of a plurality of capacitors Cbst and a plurality of third transistors M3, whereby discharging efficiency may be improved in all areas of the control line CL and therefore an off current capable of being transferred to an organic light emitting diode may be prevented from occurring.

According to another example, the voltage discharge portion 145 of the demultiplexing circuit portion 140 may include a second transistor M2 corresponding to each of a plurality of capacitors Cbst and a plurality of third transistors M3. For example, if the display apparatus includes n data lines DL1 to DLn and the demultiplexing circuit portion 140 is connected with three control lines CL_A, CL_B and CL_C, since one control line CL is connected with n/3 data lines DL, the voltage discharge portion 145 of the demultiplexing circuit portion 140 may include n/3 second transistors M2 including a second transistor M2 arranged at each of both ends of the control line CL.

The voltage discharge portion 145 of the demultiplexing circuit portion 140 may further include a plurality of fourth transistors M4 turned on based on a power voltage VDD to supply the power voltage VDD to the discharge node DN and a plurality of fifth transistors M5 turned on based on the kth time-division control signal to discharge the discharge node DN, and the number of each of the plurality of fourth transistors M4 and the plurality of fifth transistors M5 may be equal to the number of the second transistors M2. Therefore, the second, fourth and fifth transistors M2, M4 and M5 may constitute one voltage discharge portion 145, whereby discharging efficiency of the control line CL may be improved.

The description of the demultiplexing circuit portion 140 according to one example and another example is only exemplary, and is not limited to the number of the transistors. Therefore, the voltage discharge portion 145 of the demultiplexing circuit portion 140 may improve discharging efficiency in all areas of the control line CL and control the number of the second, fourth and fifth transistors M2, M4 and M5 within the range that does not need excessive cost.

Figure 22:
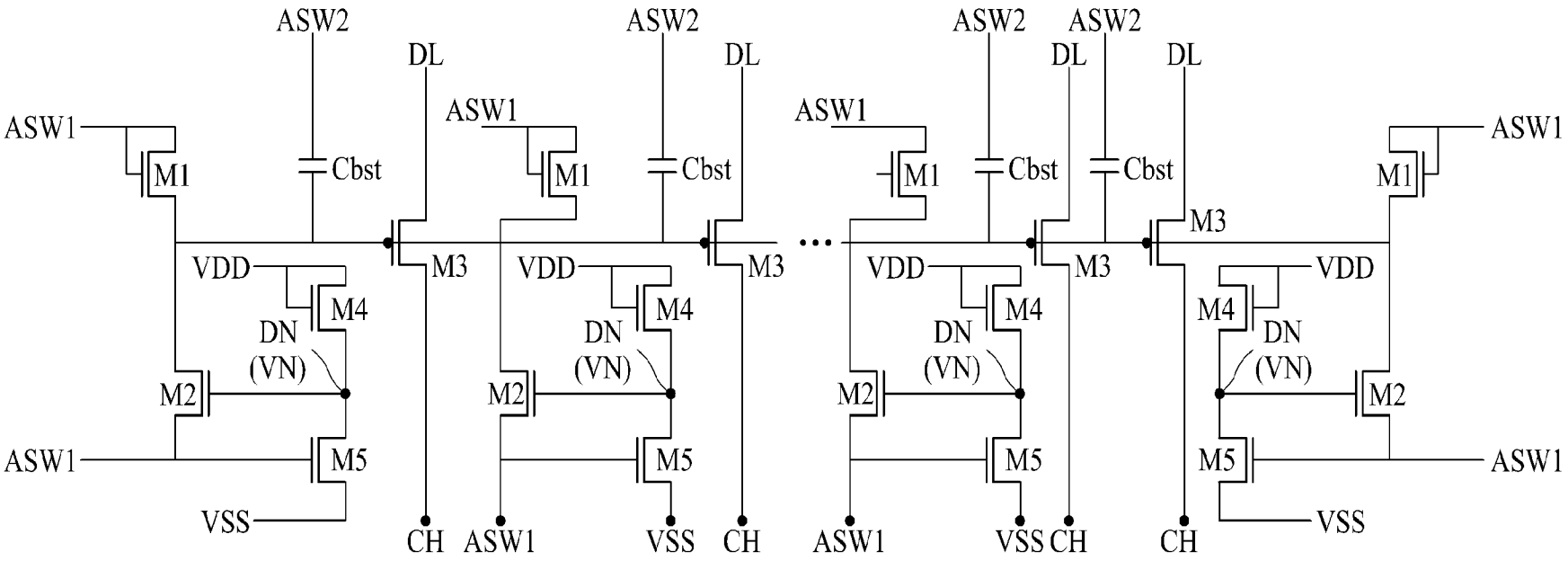
FIG. 22 is a circuit view illustrating further still another example of a demultiplexing circuit portion shown in FIG. 12.

FIG. 22 is a circuit view illustrating further still another example of the demultiplexing circuit portion shown in FIG. 12.

Referring to FIG. 22, the demultiplexing circuit portion 140 may include two first transistors M1 and two second transistors M2, which are arranged at each of both ends of one control line CL, wherein one control line CL may be connected with a plurality of capacitors Cbst and a plurality of third transistors M3.

The voltage controller 141 may further include p number of first transistors M1 (p is a natural number of 1 to (n/i−2)) turned on based on a kth time-division control signal to supply the kth time-division control signal to a kth control line, and the voltage discharge portion 145 may further include p number of second transistors M2 (p is a natural number of 1 to (n/i−2)) turned on based on a voltage VN of a discharge node controlled by the kth time-division control signal to discharge the kth control line CL, whereby both charging efficiency and discharging efficiency of the control line CL may be improved.

According to one example, the demultiplexing circuit portion 140 may further include a pair of first transistor M1 and second transistor M2 by grouping a plurality of capacitors Cbst and a plurality of third transistors M3 in a predetermined unit to correspond to each of the plurality of groups. For example, if the display apparatus includes n data lines DL1 to DLn and the demultiplexing circuit portion 140 is connected with three control lines CL_A, CL_B and CL_C, since one control line CL is connected with n/3 data lines DL, the demultiplexing circuit portion 140 may include n/3 third transistors M3 connected with one control line CL. At this time, the demultiplexing circuit portion 140 may further include n/30 first and second transistors M1 and M2 in pairs by grouping a plurality of capacitors Cbst and a plurality of third transistors M3 in a unit of 10 capacitors Cbst and 10 third transistors M3. In this way, the demultiplexing circuit portion 140 may further include first and second transistors M1 and M2 corresponding to each of a plurality of groups of a plurality of capacitors Cbst and a plurality of third transistors M3, whereby charging efficiency and discharging efficiency may simultaneously be improved in all areas of the control line CL to stably maintain the voltage VA of the control line CL and overcome a limitation caused by degradation of the second transistor M2 and therefore an off current capable of being transferred to an organic light emitting diode may be prevented from occurring.

According to another example, the demultiplexing circuit portion 140 may include a pair of first and second transistors M1 and M2 corresponding to each of a plurality of capacitors Cbst and a plurality of third transistors M3. For example, if the display apparatus includes n data lines DL1 to DLn and the demultiplexing circuit portion 140 is connected with three control lines CL_A, CL_B and CL_C, since one control line CL is connected with n/3 data lines DL, the demultiplexing circuit portion 140 may include n/3 first and second transistors M2 in pairs including a pair of first and second transistors M1 and M2 arranged at each of both ends of the control line CL.

According to one example, if the number of the first transistors M1 is equal to the number of the second transistors M2, the demultiplexing circuit portion 140 may divide the kth control line CL into control lines equivalent to the number of the first and second transistors M1 and M2 and charge and discharge the voltage VA of the divided kth control line CL through a pair of first and second transistors M1 and M2. At this time, the demultiplexing circuit portion 140 may minimize a time constant (t=RC) according to resistor and capacitor connected to the control line CL by dividing the control line CL. Therefore, the demultiplexing circuit portion 140 may enable high speed driving by dividing the control line CL, and may embody image of high resolution while reducing the number of output channels CH.

The voltage discharge portion 145 of the demultiplexing circuit portion 140 may further include a plurality of fourth transistors M4 turned on based on a power voltage VDD to supply the power voltage VDD to the discharge node DN and a plurality of fifth transistors M5 turned on based on the kth time-division control signal to discharge the discharge node DN, and the number of each of the plurality of fourth transistors M4 and the plurality of fifth transistors M5 may be equal to the number of the second transistors M2. Therefore, the second, fourth and fifth transistors M2, M4 and M5 may constitute one voltage discharge portion 145, whereby discharging efficiency of the control line CL may be improved.

The description of the demultiplexing circuit portion 140 according to one example and another example is only exemplary, and is not limited to the number of the transistors. Therefore, the demultiplexing circuit portion 140 may improve charging efficiency and discharging efficiency in all areas of the control line CL and control the number of the first, second, fourth and fifth transistors M1, M2, M4 and M5 in pairs within the range that does not need excessive cost.

Figure 23:
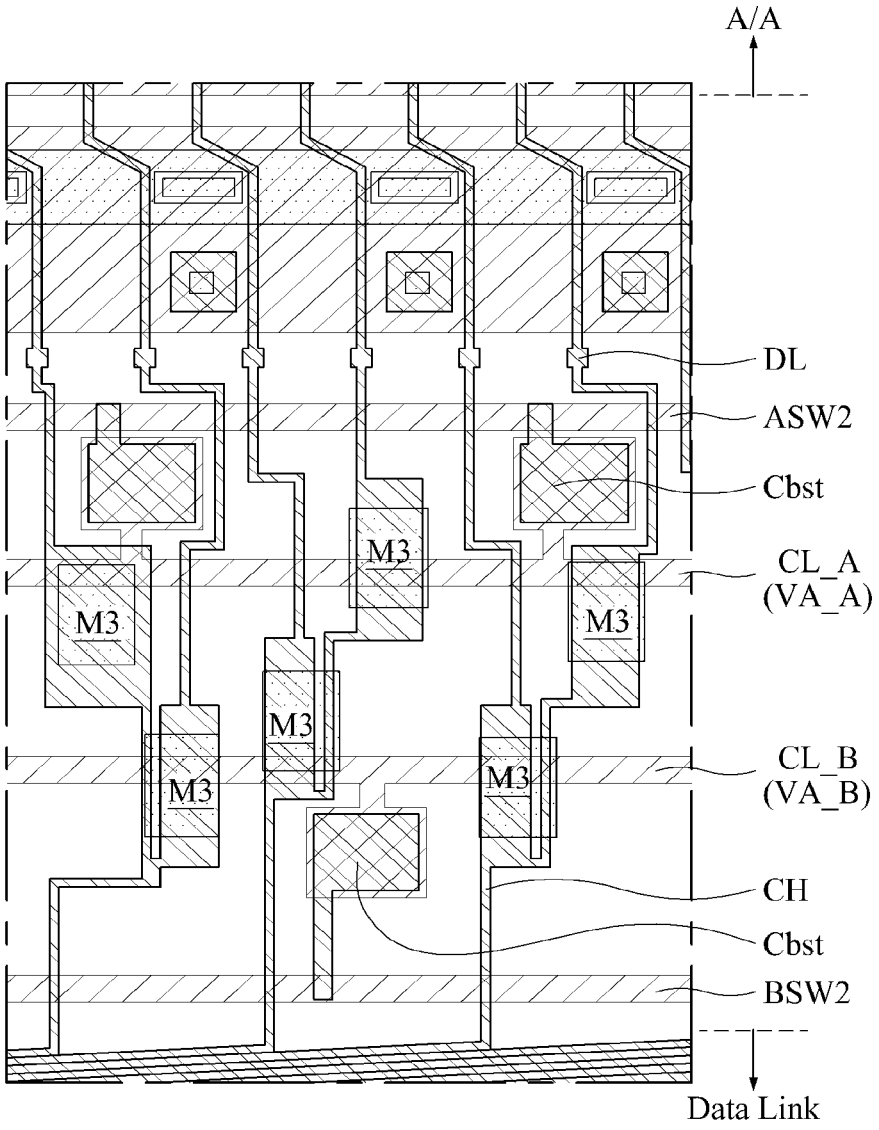
FIG. 23 is a plane view briefly illustrating a layout of a demultiplexing circuit portion shown in FIG. 1.
Figure 24:
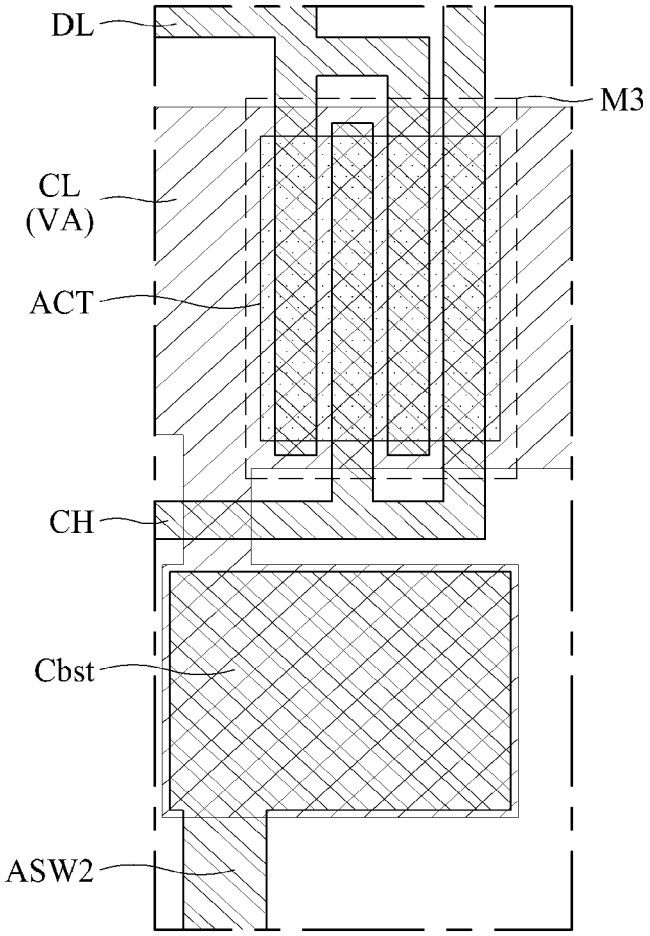
FIG. 24 is a view partially illustrating an example of a demultiplexing circuit portion shown in FIG. 23.

FIG. 23 is a plane view briefly illustrating a layout of the demultiplexing circuit portion shown in FIG. 1, and FIG. 24 is a view partially illustrating an example of the demultiplexing circuit portion shown in FIG. 23.

Referring to FIGS. 23 and 24, if the demultiplexing circuit portion 140 is connected with two control lines CL_A and CL_B and connected with n data lines DL, the plurality of driving integrated circuits 123 of the data driving circuit portion 120 may have n/2 output channels CH. Therefore, as the display apparatus comprises the demultiplexing circuit portion 140 connected with two control lines CL_A and CL_B, image of high resolution may be embodied while the number of output channels CH of the plurality of driving integrated circuits 123 may be reduced to ½ as compared with the display apparatus that does not comprise the demultiplexing circuit portion 140.

Each of the plurality of driving integrated circuits 123 may supply a data signal to the demultiplexing circuit portion 140 through a plurality of output channels CH connected with a data link. The first and second control lines CL_A and CL_B may be extended in a first direction, and may be arranged to be spaced apart from each other in a second direction. In this case, the demultiplexing circuit portion 140 may supply a data signal DS1 to first data lines DL1, DL3, . . . , DLn−1 of two data lines DL corresponding to each of the plurality of output channels CH by turning on the third transistor M3 connected with the first control line CL_A, and may supply a data signal DS2 to second data lines DL2, DL4, . . . , DLn of two data lines DL corresponding to each of the plurality of output channels CH by turning on the third transistor M3 connected with the second control line CL_B. In this case, an input line of the first auxiliary signal ASW2 may be arranged between the first control line CL_A and the display area A/A and an input line of the second auxiliary signal BSW2 may be arranged between the second control line CL_B and the data link, but may not be limited to this arrangement. The first and second time-division control signals ASW1 and BSW1 may freely be arranged at one side or the other side of each of the first and second control lines CL_A and CL_B.

The capacitor Cbst may include a first electrode provided on the same layer as the gate electrode of the third transistor M3, and a second electrode spaced apart from the source electrode and the drain electrode of the third transistor M3 on the same layer as the source electrode and the drain electrode of the third transistor M3.

According to one example, the capacitor Cbst may be arranged between the first control line CL_A and the input line of the first auxiliary signal ASW2 or between the second control line CL_B and the input line of the second auxiliary signal BSW2. For example, the capacitor Cbst may be arranged to correspond to each of the third transistors M3 of the switching portion 143. For another example, the capacitor Cbst may be arranged by grouping a plurality of third transistors M3 in a predetermined unit to correspond to each of the plurality of groups.

According to one example, the drain electrode of the third transistor M3 may be connected with the output channel CH of the driving integrated circuit 123, and may have two divergences. The source electrode of the third transistor M3 may be connected with the data line DL, and may have two divergences. Two divergences of the drain electrode of the third transistor M3 and two divergences of the source electrode of the third transistor M3 may alternately be arranged in an area overlapped with the gate electrode of the third transistor M3. For example, one divergence of the drain electrode of the third transistor M3 may be arranged between two divergences of the source electrode of the third transistor M3, and one divergence of the source electrode of the third transistor M3 may be arranged between two divergences of the drain electrode of the third transistor M3. In this way, as each of the drain electrode and the source electrode of the third transistor M3 may include two divergences, the demultiplexing circuit portion 140 may minimize a layout area where one third transistor M3 is arranged.

Figure 25:
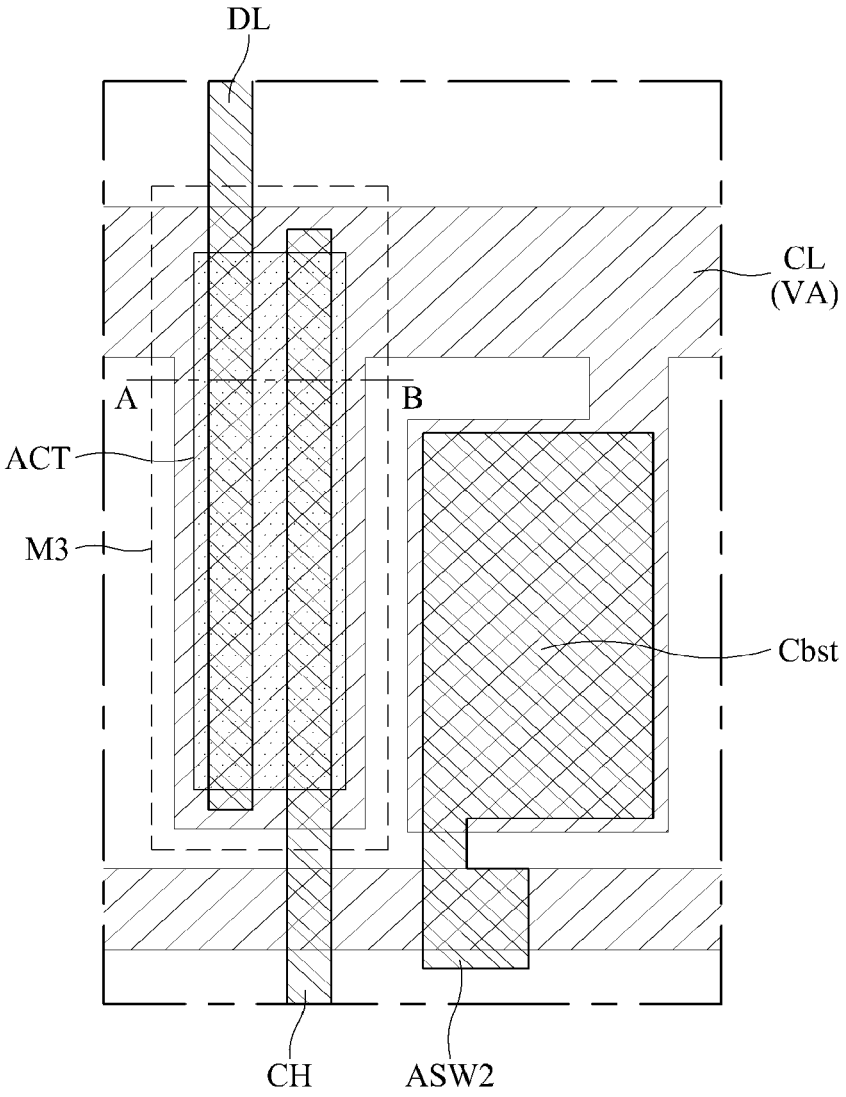
FIG. 25 is a view partially illustrating another example of a demultiplexing circuit portion shown in FIG. 23.

FIG. 25 is a view partially illustrating another example of the demultiplexing circuit portion shown in FIG. 23.

Referring to FIG. 25, the control line CL may be connected with the gate electrode of the third transistor M3 while being extended in a first direction, and the input line of the first auxiliary signal ASW2 may be connected with the second electrode of the capacitor Cbst while being extended in a first direction to be spaced apart from the control line CL. The gate electrode of the third transistor M3 may be arranged between the control line CL and the input line of the first auxiliary signal ASW2. The drain electrode of the third transistor M3 may be overlapped with the gate electrode of the third transistor M3 while being connected with the output channel CH of the driving integrated circuit 123, and the source electrode of the third transistor M3 may be overlapped with the gate electrode of the third transistor M3 while being connected with the data line DL. That is, the drain electrode and the source electrode of the third transistor M3 may be arranged to be spaced apart from each other on the same layer.

The capacitor Cbst may be arranged at one side of the gate electrode of the third transistor M3 while being arranged between the control line CL and the input line of the first auxiliary signal ASW2. At this time, the capacitor Cbst may have a size corresponding to a length of the drain and source electrodes of the third transistor M3, which are overlapped with the gate electrode. For example, if each of the drain electrode and the source electrode of the third transistor M3 does not have a plurality of divergences, its length overlapped with the gate electrode may be longer than the case that each of the drain electrode and the source electrode of the third transistor M3 has a plurality of divergences. At this time, if the length of each of the drain electrode and the source electrode of the third transistor M3, which is overlapped with the gate electrode, becomes longer, the length of the capacitor Cbst may be increased.

Various designs and modifications may be made in the layout of the aforementioned control line CL, the aforementioned input line of the first auxiliary signal ASW2, the aforementioned third transistor M3, and the aforementioned capacitor Cbst in accordance with other matters without limitation to the aforementioned description and drawings.

Figure 26:
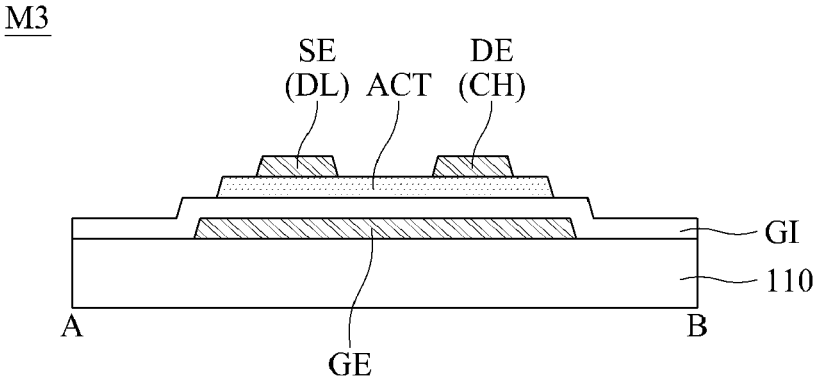
FIG. 26 is one example of a cross-sectional view taken along line A-B shown in FIG. 25.

FIG. 26 is one example of a cross-sectional view taken along line A-B shown in FIG. 25.

Referring to FIG. 26, the third transistor M3 may include a gate electrode GE, a gate insulating film GI, an oxide semiconductor layer ACT, a source electrode SE, and a drain electrode DE.

The gate electrode GE may be arranged on the substrate 110 and electrically be connected with the control line CL. According to one example, the gate electrode GE may include at least one of Al based metal such as Al and Al alloy, Ag based metal such as Ag and Ag alloy, Cu based metal such as Cu and Cu alloy, Mo based material such as Mo and Mo alloy, Cr, Ta, Nd and Ti. Also, the gate electrode GE may have a multi-layered structure that includes at least two conductive films having their respective physical properties different from each other.

The gate insulating film GI may be arranged on the gate electrode GE. According to one example, the gate insulting film GI may include at least one of silicon oxide and silicon nitride, or may include Al2O3. The gate insulating film GI may have a single film structure or a multi-layered structure.

The oxide semiconductor layer ACT may be arranged on the gate insulating film GI to partially overlap the gate electrode GE. The oxide semiconductor layer ACT may correspond to a channel layer or an active layer. According to one example, the oxide semiconductor layer ACT may include an oxide semiconductor material. For example, the oxide semiconductor layer ACT may be made of an oxide semiconductor material such as IZO (InZnO)-, IGO (InGaO)-, ITO (InSnO)-, IGZO (InGaZnO)-, IGZTO (InGaZnSnO), GZTO (GaZnSnO)-, GZO (GaZnO)-, and ITZO (InSnZnO)-based oxide semiconductor materials. However, the oxide semiconductor layer ACT is not limited to the above materials, and may be made of other oxide semiconductor materials known in the art.

The source electrode SE may be arranged on the oxide semiconductor layer ACT and electrically connected with the data line DL. The drain electrode DE may be arranged to be spaced apart from the source electrode SE on the oxide semiconductor layer ACT and electrically connected with the output channel CH of the driving integrated circuit 123.

The source electrode SE and the drain electrode DE may include at least one of Mo, Al, Cr, Au, Ti, Ni, Nd, Cu, and their alloy. Each of the source electrode SE and the drain electrode DE may be made of a single layer of metal or metal alloy or a multi-layer of two or more layers.

As described above, the demultiplexing circuit portion 140 may be made of an oxide based thin film transistor. In detail, transistors of the demultiplexing circuit portion 140 have a back channel etch (BCE) structure in which a channel area is exposed during a process of forming the source electrode SE and the drain electrode DE. Since the display apparatus according to the present disclosure embodies the demultiplexing circuit portion using an oxide based thin film transistor through the BCE process, it is possible to minimize a mask process, improve a lithography process margin and provide excellent reliability.

Figure 27:
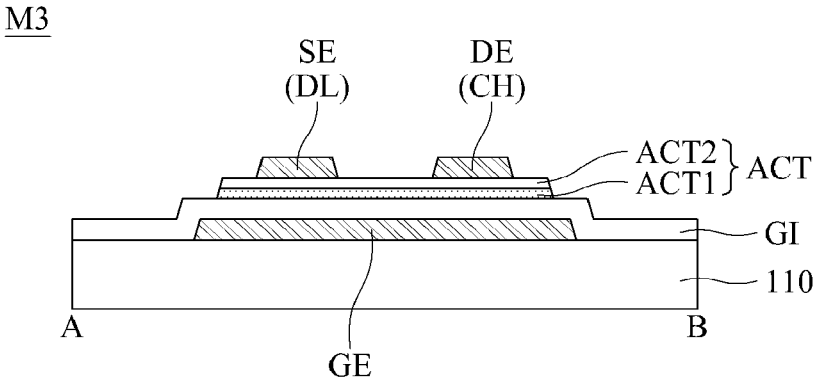
FIG. 27 is another example of a cross-sectional view taken along line A-B shown in FIG. 25.

FIG. 27 is another example of a cross-sectional view taken along line A-B shown in FIG. 25.

Referring to FIG. 27, the third transistor M3 may include a gate electrode GE, a gate insulating film GI, an oxide semiconductor layer ACT, a source electrode SE, and a drain electrode DE, wherein the oxide semiconductor layer ACT may include first and second oxide semiconductor layers ACT1 and ACT2.

The first oxide semiconductor layer ACT1 may be arranged on the gate insulating film GI to partially overlap the gate electrode GE. The first oxide semiconductor layer ACT1 may correspond to a channel layer or an active layer. According to one example, the first oxide semiconductor layer ACT1 may include an oxide semiconductor material. For example, the first oxide semiconductor layer ACT1 may be made of an oxide semiconductor material such as IZO (InZnO)-, IGO (InGaO)-, ITO (InSnO)-, IGZO (InGaZnO)-, IGZTO (InGaZnSnO), GZTO (GaZnSnO)-, GZO (GaZnO)-, and ITZO (InSnZnO)-based oxide semiconductor materials. However, the first oxide semiconductor layer ACT1 is not limited to the above materials, and may be made of other oxide semiconductor materials known in the art.

The second oxide semiconductor layer ACT2 may be arranged on the first oxide semiconductor layer ACT1 to protect the first oxide semiconductor layer ACT1. In detail, the second oxide semiconductor layer ACT2 may include nitrogen of a concentration higher than that of the first oxide semiconductor layer ACT1, and may have film stability more excellent than that of the first oxide semiconductor layer ACT1. For example, the nitrogen contained in the second oxide semiconductor layer ACT2 may form a stable bonding with oxygen, and may stably be arranged between metal elements. In this way, the second oxide semiconductor layer ACT2 containing nitrogen may have excellent film stability. Since the second oxide semiconductor layer ACT2 has excellent durability with respect to processes such as exposure, etching, patterning and heat treatment to manufacture the thin film transistor, the second oxide semiconductor layer ACT2 may protect the first oxide semiconductor layer ACT1 there below.

As described above, the demultiplexing circuit portion 140 may be made of an oxide based thin film transistor. In detail, transistors of the demultiplexing circuit portion 140 have a back channel etch (BCE) structure in which a channel area is exposed during a process of forming the source electrode SE and the drain electrode DE. For example, the channel area of the demultiplexing circuit portion 140 may be exposed from the source electrode SE and the drain electrode DE by etching and patterning for forming the source electrode SE and the drain electrode DE during a process of manufacturing a thin film transistor of a BCE structure. At this time, the oxide semiconductor layer ACT may be exposed to an etching gas or an etching solution. Although the second oxide semiconductor layer ACT2 is exposed to an etching gas or an etching solution, since the second oxide semiconductor layer ACT2 includes nitrogen and therefore has excellent film stability, the demultiplexing circuit portion 140 according to the present disclosure is not damaged by the etching gas or the etching solution. Therefore, since the second oxide semiconductor layer ACT2 has excellent film stability over all areas, the second oxide semiconductor layer ACT2 may efficiently protect the first oxide semiconductor layer ACT1.

As a result, since the display apparatus according to the present disclosure embodies the demultiplexing circuit portion using an oxide based thin film transistor through the BCE process, it is possible to minimize a mask process, improve a lithography process margin and provide excellent reliability.

Also, since the display apparatus according to the present disclosure comprises a demultiplexing circuit portion using an oxide based thin film transistor, the demultiplexing circuit portion is capable of maintaining a stable output by overcoming a limitation due to low mobility and degradation as compared with an LTPS based thin film transistor by reinforcing a discharging function of a control line in response to a time-division control signal. Since the display apparatus comprises a demultiplexing circuit portion using an oxide based thin film transistor, an off current capable of being transferred to an organic light emitting diode may be prevented from occurring, a bezel area may be minimized, and an image of high resolution of a display panel may be embodied. Also, a demultiplexing circuit portion using an oxide based thin film transistor is embodied through a back channel etch (BCE) process, whereby it is possible to minimize a mask process, improve a lithography process margin and provide excellent reliability.

It will be apparent to those skilled in the art that the present disclosure described above is not limited by the above-described aspects and the accompanying drawings and that various substitutions, modifications, and variations can be made in the present disclosure without departing from the spirit or scope of the disclosures. Consequently, the scope of the present disclosure is defined by the accompanying claims, and it is intended that all variations or modifications derived from the meaning, scope, and equivalent concept of the claims fall within the scope of the present disclosure.

The various aspects described above can be combined to provide further aspects. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the aspects can be modified, if necessary to employ concepts of the various patents, applications and publications to provide yet further aspects.

These and other changes can be made to the aspects in light of the above-detailed description. In general, in the following claims, the terms used should not be construed to limit the claims to the specific aspects disclosed in the specification and the claims, but should be construed to include all possible aspects along with the full scope of equivalents to which such claims are entitled. Accordingly, the claims are not limited by the disclosure.

What is claimed is:

1. A display apparatus comprising a demultiplexing circuit portion that sequentially supplies data signals supplied from a data driving circuit to at least two data lines, the demultiplexing circuit portion comprising:

a switching portion that sequentially supplies the data signals to the at least two data lines based on a voltage of a control line;

a voltage controller that controls charges the voltage of the control line in response to a first time-division control signal; and a voltage discharge portion that discharges the voltage of the control line to a first level of the first time-division control signal in response to the first time-division control signal, wherein the voltage discharge portion includes a second transistor turned on based on a voltage of a discharge node controlled by the first time-division control signal and discharges the voltage of the control line to the first level of the first time-division control signal.

2. The display apparatus of claim 1, wherein the voltage discharge portion further includes:

a fourth transistor turned on based on a first power voltage and supplying the first power voltage to the discharge node; and a fifth transistor turned on based on the first time-division control signal and discharging the voltage of the discharge node to a second power voltage.

3. The display apparatus of claim 1, wherein the discharge node has a voltage inverted with the first time-division control signal.

4. The display apparatus of claim 1, wherein the switching portion includes a third transistor turned on from the first transition time period of the first time-division control signal to the second transition time period of the first time-division control signal, sequentially supplying the data signals to the at least two data lines.

5. The display apparatus of claim 1, wherein the switching portion includes a third transistor turned on based on the voltage of the control line, wherein the third transistor comprising:

a gate electrode disposed on a substrate and electrically connected to the control line;

a gate insulating film disposed on the gate electrode;

an oxide semiconductor layer disposed on the gate insulating film and partially overlapping the gate electrode;

a source electrode disposed on the oxide semiconductor layer; and a drain electrode spaced apart from the source electrode on the oxide semiconductor layer.

6. The display apparatus of claim 5, wherein the oxide semiconductor layer includes:

a first oxide semiconductor layer disposed on the gate insulating film; and a second oxide semiconductor layer disposed on the first oxide semiconductor layer and protecting the first oxide semiconductor layer.

7. The display apparatus of claim 6, wherein the second oxide semiconductor layer has a nitrogen concentration higher than that of the first oxide semiconductor layer and has a film stability better than that of the first oxide semiconductor layer.

8. The display apparatus of claim 5, wherein the voltage controller includes a capacitor for further increasing the voltage of the control line based on an auxiliary signal associated with the time-division control signal, wherein the capacitor comprising:

a first electrode disposed on a same layer as that of a gate electrode of the third transistor; and a second electrode disposed on a same layer as source and drain electrodes of the third transistor and spaced apart from the source and drain electrodes of the third transistor.

9. The display apparatus of claim 1, wherein the time-division control signal includes first to third time-division control signals sequentially supplied for one horizontal period, the first and second time-division control signals partially overlapping each other, and the second and third time-division control signals partially overlapping each other.

10. The display apparatus of claim 9, wherein the data driving circuit supplies first to third data signals respectively corresponding to the first to third time-division control signals to the demultiplexing circuit portion, and a first transition time period of each of the first to third data signals is delayed more than a first transition time period of each of the first to third time-division control signals.

11. The display apparatus of claim 1, wherein the voltage controller includes a first transistor turned on based on a second level of the first time-division control signal and supplies the second level of the first time-division control signal to the control line.

12. The display apparatus of claim 11, wherein the voltage controller further includes a capacitor for further increasing the voltage of the control line based on a second level of a first auxiliary signal partially overlapping the second level of the first time-division control signal.

13. The display apparatus of claim 12, wherein the first auxiliary signal has a first transition time period corresponding to a time period between a first transition time period and a second transition time period of the first time-division control signal.

14. A display apparatus comprising:

n data lines;

a demultiplexing circuit portion connected to first to $i^{th}$ (i is a natural number of 2 or more) control lines and connected to the n data lines; and a data driving circuit having first to $n/i^{th}$ output channels connected to the demultiplexing circuit portion, wherein the demultiplexing circuit portion comprising:

a voltage controller that controls voltages of the first to $i^{th}$ control lines in response to first to ith time-division control signals;

a switching portion that sequentially supplies data signals supplied from the first to $n/i^{th}$ output channels to the n data lines based on the voltages of the first to $i^{th}$ control lines; and a voltage discharge portion that discharges the voltages of the first to $i^{th}$ control lines in response to the first to $i^{th}$ time-division control signals, wherein:

the voltage controller includes two first transistors connected to each of both ends of a $k^{th}$ control line and turned on based on a $k^{th}$ (k is a natural number of 1 to i−1) time-division control signal and supplies the $k^{th}$ time-division control signal to the kth control line, and the voltage discharge portion includes two second transistors connected to each of both ends of the $k^{th}$ control line and turned on based on a voltage of a discharge node controlled by the $k^{th}$ time-division control signal, discharging the voltage of the $k^{th}$ control line to a first level of the $k^{th}$ time-division control signal.

15. The display apparatus of claim 14, wherein the voltage controller further includes p number of first transistors (p is a natural number of 1 to (n/i−2)) turned on based on the $k^{th}$ time-division control signal, supplying the $k^{th}$ time-division control signal to the kth control line.

16. The display apparatus of claim 14, wherein the voltage discharge portion further includes p number of second transistors (p is a natural number of 1 to (n/i−2)) turned on based on the voltage of the discharge node controlled by the $k^{th}$ time-division control signal, discharging the kth control line.

17. The display apparatus of claim 14, wherein the voltage controller further includes p number of first transistors (p is a natural number of 1 to (n/i−2)) turned on based on the $k^{th}$ time-division control signal, supplying the $k^{th}$ time-division control signal to the $k^{th}$ control line, and the voltage discharge portion further includes p number of second transistors (p is a natural number of 1 to (n/i−2)) turned on based on the voltage of the discharge node controlled by the $k^{th}$ time-division control signal, discharging the $k^{th}$ control line.

18. The display apparatus of claim 17, wherein the $k^{th}$ control line is divided into the number of the first and second transistors and the voltage of the $k^{th}$ control line is charged and discharged through a pair of the first and second transistors.

19. The display apparatus of claim 14, wherein the voltage discharge portion further includes:

a plurality of fourth transistors turned on based on a first power voltage and supplying the first power voltage to the discharge node; and a plurality of fifth transistors turned on based on the kth time-division control signal and discharging the voltage of the discharge node to a second power voltage, and each of the number of the plurality of fourth transistors and the number of the plurality of fifth transistors is equal to the number of the second transistors.

* * * * *